US009604812B2

(12) United States Patent
Hata et al.

(10) Patent No.: US 9,604,812 B2
(45) Date of Patent: Mar. 28, 2017

(54) MEDIUM PROCESSING APPARATUS

(71) Applicant: Oki Electric Industry Co., Ltd., Tokyo (JP)

(72) Inventors: Naoki Hata, Tokyo (JP); Masamitsu Asamura, Tokyo (JP); Masashi Kashiwabuchi, Tokyo (JP); Kei Iwatsuki, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 327 days.

(21) Appl. No.: 14/377,291

(22) PCT Filed: Mar. 7, 2013

(86) PCT No.: PCT/JP2013/056359
§ 371 (c)(1),
(2) Date: Aug. 7, 2014

(87) PCT Pub. No.: WO2013/146173
PCT Pub. Date: Oct. 3, 2013

(65) Prior Publication Data

US 2015/0048197 A1 Feb. 19, 2015

(30) Foreign Application Priority Data

Mar. 28, 2012 (JP) ..... 2012-073996

(51) Int. Cl.
*B65H 39/14* (2006.01)
*B65H 29/00* (2006.01)
*B65H 5/28* (2006.01)

(52) U.S. Cl.
CPC ..... *B65H 29/006* (2013.01); *B65H 5/28* (2013.01); *B65H 39/14* (2013.01);
(Continued)

(58) Field of Classification Search
CPC ..... B65H 5/28; B65H 29/006; B65H 2301/41912; B65H 2511/51;
(Continued)

(56) References Cited

U.S. PATENT DOCUMENTS 6,585,098 B2 * 7/2003 Satou ..... B65H 29/006 194/206
2003/0116400 A1 * 6/2003 Saltsov ..... B65H 29/006 194/207

(Continued)

FOREIGN PATENT DOCUMENTS

CN 102236932 A 11/2011
JP H08-67382 A 3/1996

(Continued)

*Primary Examiner* — Mark Beauchaine
(74) *Attorney, Agent, or Firm* — Rabin & Berdo, P.C.

(57) ABSTRACT

A temporary holding section includes bridge portions that span along a shaft direction across respective groove portions of a drum at plural discrete locations around the drum circumferential direction. The temporary holding section can accordingly prevent an outer tape and an inner tape from slipping off into the groove portions, enabling damage to the tapes to be forestalled. The temporary holding section can also precisely determine the presence or absence of a banknote by shining a drum detection light toward the groove portions so as to pass through opening hole portions.

8 Claims, 16 Drawing Sheets

(52) U.S. Cl.
CPC *B65H 2301/41912* (2013.01); *B65H 2511/51* (2013.01); *B65H 2553/412* (2013.01); *B65H 2553/414* (2013.01); *B65H 2553/416* (2013.01); *B65H 2553/51* (2013.01); *B65H 2701/1912* (2013.01)

(58) Field of Classification Search
CPC ..... B65H 2553/412; B65H 2553/414; B65H 2553/51; B65H 2701/1912; B65H 39/14
USPC ..... 194/206; 242/528
See application file for complete search history.

(56) References Cited

U.S. PATENT DOCUMENTS

| | | | |
|---|---|---|---|
| 2010/0100245 | A1 | 4/2010 | Oishi et al. |
| 2011/0198192 | A1 | 8/2011 | Togiya et al. |

FOREIGN PATENT DOCUMENTS

| | | | |
|---|---|---|---|
| JP | H11-139617 | A | 5/1999 |
| JP | 3681524 | B2 | 8/2005 |
| JP | 2010-095340 | A | 4/2010 |
| JP | 2011-002921 | A | 1/2011 |

* cited by examiner

MEDIUM PROCESSING APPARATUS

TECHNICAL FIELD

The present invention relates to a medium processing apparatus that is, for example, well suited for application to an Automated Teller Machine (ATM) input with a medium such as banknotes to perform desired transactions.

BACKGROUND ART

Hitherto, automated teller machines, such as those employed in financial institutions, allow a customer to pay in cash, such as coins or banknotes, and pay out cash to a customer, according to the contents of a customer transaction.

An example of technology proposed for such an automated teller machine includes a banknote pay-in/pay-out port that accepts and dispenses banknotes for a customer, a classification section that classifies the denomination and authenticity of inserted banknotes, a temporary holding section that temporarily holds inserted banknotes, and banknote cassettes that store banknotes for each denomination (see for example Japanese Patent Application Laid-Open (JP-A) No. 2011-2921 (FIG. 1)).

In this automated teller machine, when a customer has inserted banknotes into the banknote pay-in/pay-out port in a pay-in transaction, the inserted banknotes are classified in the classification section. The automated teller machine then holds banknotes classified as normal banknotes in the temporary holding section, and banknotes that are classified as unsuitable for use in the transaction are replaced in the banknote pay-in/pay-out port and returned to the customer. Then, when the customer has approved the pay-in amount, the automated teller machine reclassifies the banknotes held in the temporary holding section by denomination in the classification section, and the banknotes are stored in the respective banknote cassettes according to their classified denomination.

As an example of such a temporary holding section, technology is proposed in which one end of a long, narrow tape is fixed to a circumferential side face of a circular cylinder shaped drum, with the drum being rotated in a predetermined direction to wind and hold banknotes against the drum circumferential side face together with the tape (see for example (FIG. 1 of) JP-A No. 2010-095340). In this temporary holding section, the drum is rotated in the opposite direction of the drum to release the banknotes.

It is desirable for the temporary holding section to dispense all of the held banknotes at the end of each transaction, such that banknotes held during the following transaction processing are not mixed with other banknotes.

Technology is accordingly proposed in which, as illustrated in FIG. 14A, grooves 654 are formed around the circumferential direction of a drum 625 inside a temporary holding section, and sensors detect whether or not a predetermined detection light has passed through the grooves 654. In such a temporary holding section a sensor is able to make precise detection that not even a single thin banknote remains.

DISCLOSURE OF INVENTION

Technical Problem

However, in such a temporary holding section, when a tape is wound on manually during a maintenance operation, for example, it is conceivable that the winding position of a tape 631 may become displaced in the drum 625 width direction as illustrated in FIG. 14B.

In particular, when the tape 631 winding position is displaced by a large amount, the tape 631 may slip off into the grooves 654 as illustrated in FIG. 14C. There is then a concern that banknote holding processing in the temporary holding section might no longer be able to be performed due to tangling or snapping of the tape.

In consideration of the above circumstances, the present invention proposes a medium processing apparatus capable of raising the precision of processing to hold a paper sheet-shaped medium wound onto a drum.

Solution to Problem

In order to solve the above problems, a medium processing apparatus of the present invention includes: a drum that is formed in a substantially circular cylinder shape, and that rotates about a central shaft at the center of the circular cylinder; a tape that is wound onto a circumferential side face of the drum together with a paper sheet shaped medium; a groove portion that is formed around the circumferential direction of the drum; plural bridge portions that span between the two sides of the groove portion at discrete locations around the drum circumferential direction; a detection unit that emits detection light toward the groove portion and that receives the detection light that has passed through an opening hole portion that is a gap between the bridge portions in the groove portion; and a controller that determines whether or not the medium is wound onto the circumferential side face of the drum based on a light reception result for the detection light by the detection unit.

In the medium processing apparatus of the present invention, the controller is accordingly able to determine whether or not a medium has been wound onto the drum circumferential side face based on whether or not the detection unit is able to receive the detection light that has passed through the opening hole portion. The bridge portions of the medium processing apparatus of the present invention are moreover capable of preventing the tape from slipping off into the groove portion even when the tape has been displaced from its original winding position, thus enabling damage to the tape to be forestalled.

Advantageous Effects of Invention

According to the present invention, the controller is able to determine whether or not a medium has been wound onto the drum circumferential side face based on whether or not the detection unit is able to receive the detection light that has passed through the opening hole portion. Moreover, according to the present invention, the bridge portions can prevent the tape from slipping off into the groove portion even when the tape has been displaced from its original winding position, thereby enabling damage to the tape to be forestalled. The present invention namely enables a medium processing apparatus capable of raising the precision of processing to hold a paper sheet shaped medium wound onto a drum.

BEST MODE FOR CARRYING OUT THE INVENTION

Explanation follows regarding exemplary embodiments of the present invention (referred to below as exemplary embodiments) with reference to the drawings.

1. First Exemplary Embodiment

1-1. Automated Teller Machine Overall Configuration

Figure 1:
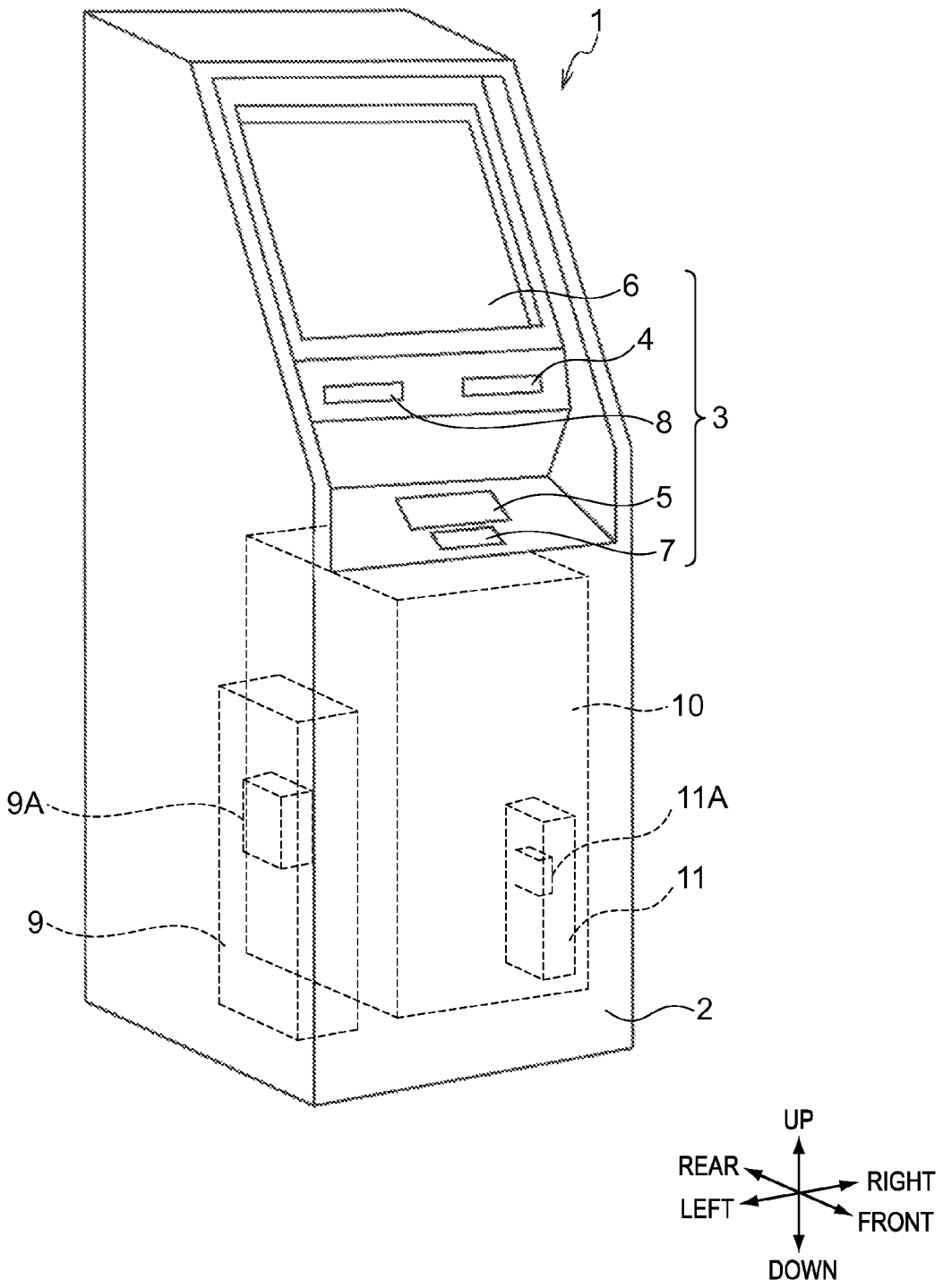
FIG. 1 is a perspective view illustrating a configuration of an automated teller machine.

As illustrated in the external view of FIG. 1, an automated teller machine 1 serving as an example of a medium processing apparatus includes a box shaped casing 2. The automated teller machine 1 is installed, such as in a financial institution, and is configured to perform cash transactions such as pay-in transactions and pay-out transactions with a customer.

The casing 2 is configured with a diagonal cut-away shape at a location enabling easy insertion of a banknote BL (see FIG. 6), serving as an example of a medium, and enabling easy operation of a touch panel by a customer facing the front side of the casing 2, namely at a portion spanning from a front face upper portion to the top face of the casing 2. The casing 2 is provided with a customer interface 3 at the portion spanning from the front face upper portion to the top face of the casing 2.

The customer interface 3 is, for example, configured to directly handle cash and passbook transactions with a customer, as well as to notify transaction-related information and receive operation instructions. The customer interface 3 is provided with a card insertion/removal port 4, a pay-in/pay-out port 5, an operation display section 6, a numeric keypad 7, and a receipt issue port 8.

The card insertion/removal port 4 is a portion for the insertion and return of various cards, such as cash cards. A card processor (not illustrated in the drawings) that reads, for example, account numbers magnetically recorded on the various cards, is provided behind the card insertion/removal port 4.

The pay-in/pay-out port 5 is a portion into which banknotes BL for paying in are inserted by a customer, and where banknotes BL for paying out to a customer are dispensed. The pay-in/pay-out port 5 is opened up, or closed off, by driving a shutter. The banknotes BL are, for example, configured by rectangular shaped paper.

The operation display section 6 is integrated with a Liquid Crystal Display (LCD) that displays operation screens during transactions, and a touch panel that is input with, for example, a transaction type selection, a Personal Identification Number (PIN), and a transaction amount.

The numeric keypad 7 is a physical keypad that receives input of the numbers 0 to 9 and the like. The numeric keypad 7 is employed during PIN and transaction amount input operations.

The receipt issue port 8 is a portion that issues a receipt printed with transaction details and the like at the end of transaction processing. A receipt processor (not illustrated in the drawings) that prints, for example, transaction details and the like, on the receipt is provided behind the receipt issue port 8.

In the following explanation of the automated teller machine 1, the front side is defined as the side facing a customer, and the rear side is defined as the opposite side to the front side. Moreover, in the explanation of the automated teller machine 1, the left side, right side, upper side and lower side are defined from the perspective of left and right as seen by a customer facing the front side.

A main controller 9 that performs integrated control of the overall automated teller machine 1, and a banknote pay-in/pay-out device 10 that performs various processing relating to the banknotes BL, are provided inside the casing 2.

The main controller 9 includes a Central Processing Unit (CPU), not illustrated in the drawings. The main controller 9 reads and executes predetermined programs from, for example, Read Only Memory (ROM) or flash memory, not illustrated in the drawings, to perform various processing such as pay-in transactions and pay-out transactions.

Inside the main controller 9 is a data storage section 9A configured by, for example, Random Access Memory (RAM), a hard disk drive, or flash memory. The main controller 9 stores various data in the data storage section 9A.

Open-and-closable doors are provided, for example, at portions of side faces, such as on the front face side or rear face side of the casing 2. Namely, as illustrated in FIG. 1, during cash transaction operations with customers, the respective doors are closed such that the banknotes BL stored inside the banknote pay-in/pay-out device 10 are protected by the casing 2. However, during a maintenance operation performed by an operator, the respective doors in the casing 2 are opened as required, enabling easy completion of tasks on each internal portion.

Figure 2:
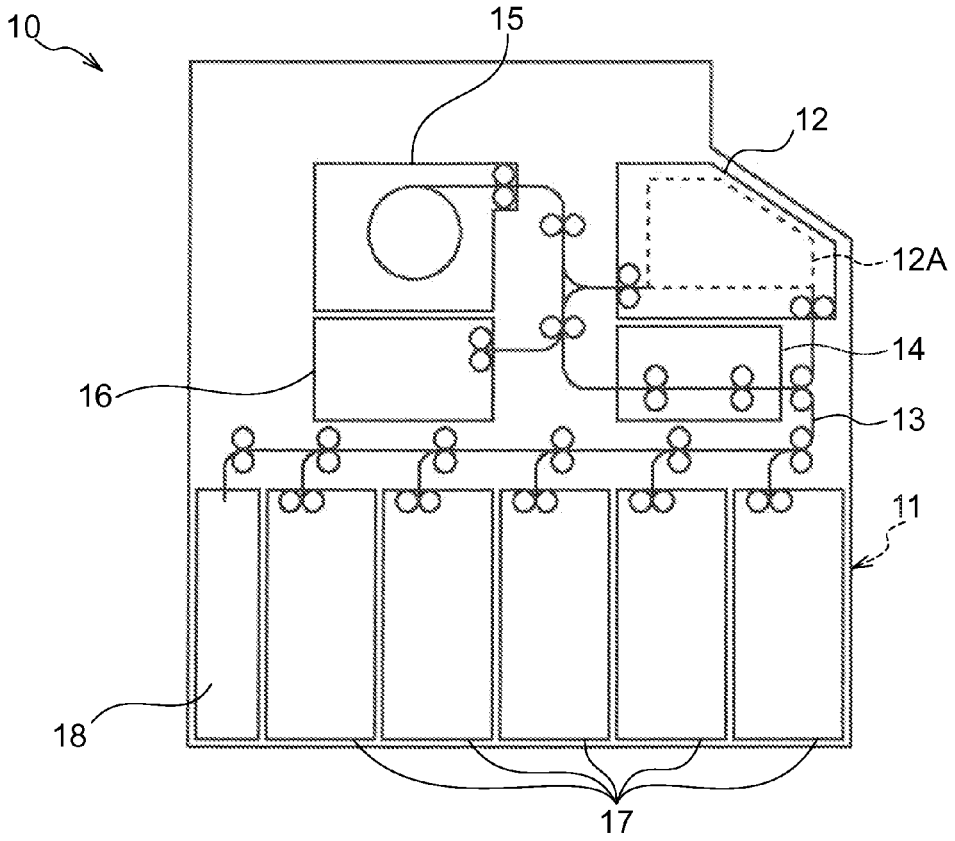
FIG. 2 is a side view illustrating a configuration of a banknote pay-in/pay-out device.

As illustrated in the side view of FIG. 2, the banknote pay-in/pay-out device 10 is configured by a combination of plural sections that perform various processing relating to the banknotes BL. Each section of the banknote pay-in/pay-out device 10 is controlled by a banknote controller 11.

The banknote controller 11 includes a CPU, not illustrated in the drawings, similarly to the main controller 9 (see FIG. 1). The banknote controller 11 reads and executes predetermined programs, such as from ROM or flash memory, not illustrated in the drawings, in order to perform various processing, such as processing to decide a banknote BL conveyance destination.

Inside the banknote controller 11 is a data storage section 11A (see FIG. 1) configured by, for example, RAM, flash memory, or the like. The banknote controller 11 stores various data in the data storage section 11A.

For example, in a pay-in transaction in which a customer pays in banknotes BL, after receiving predetermined operation input through the operation display section 6, the banknote controller 11 opens the pay-in/pay-out port 5 shutter to allow a customer to insert banknotes BL into a pay-in/pay-out section 12.

When the banknotes BL have been inserted into a receptacle 12A, the pay-in/pay-out section 12 closes the pay-in/pay-out port 5 shutter and takes the banknotes BL out of the receptacle 12A one sheet at a time, passing the banknotes BL to a conveyance section 13. The conveyance section 13 conveys the banknotes BL, configured by rectangular shaped sheets of paper, to a classification section 14, with the short edge direction of the banknotes BL running along the direction of travel.

As the banknotes BL are conveyed inside the classification section 14, optical devices or magnetic detection devices, for example, classify the banknotes BL, for example according to denomination, authenticity, and degree of wear. The classification section 14 moreover notifies banknote BL classification results to the banknote controller 11. The banknote controller 11 decides the conveyance destination of a banknote BL based on the acquired classification results.

Once the conveyance destination of a banknote has been decided, then the conveyance section 13, for example, conveys banknotes BL that the classification section 14 has classified as normal banknotes to a temporary holding section 15 where they are temporarily held. The conveyance section 13 conveys any reject banknotes, classified as unsuitable for transaction use, to the pay-in/pay-out section 12. The reject banknotes are then returned to the customer.

Next, the banknote controller 11 prompts the customer to approve the pay-in amount using the operation display section 6, and the conveyance section 13 conveys the banknotes BL held in the temporary holding section 15 to the classification section 14. The banknote controller 11 then prompts the classification section 14 to classify the banknotes BL according to, for example, denomination and degree of wear, and acquires the banknote BL classification results.

The banknote controller 11 uses the conveyance section 13 to convey banknotes BL with a large degree of wear for storage in reject cassettes 16 and 18 as banknotes BL that are unsuitable for reuse. The banknote controller 11 moreover uses the conveyance section 13 to convey banknotes BL with a small degree of wear to be stored in banknote cassettes 17 according to the banknote BL denomination, as banknotes BL for reuse.

1-2. Temporary Holding Section Configuration

Figure 3:
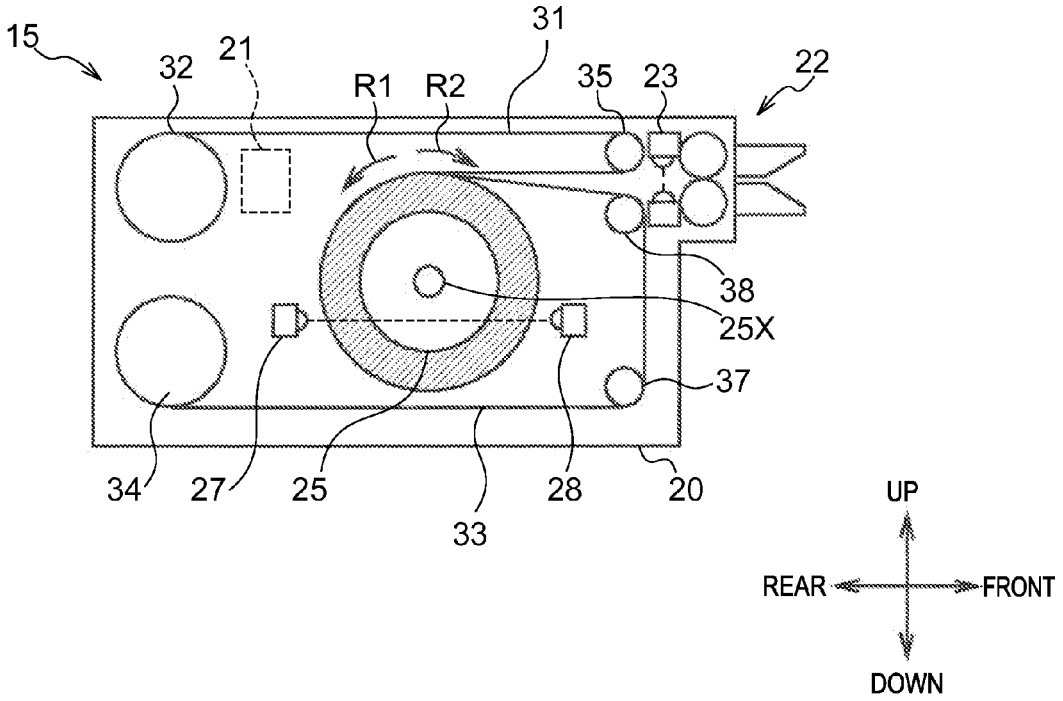
FIG. 3 is a schematic drawing illustrating a configuration (1) of a temporary holding section.

As illustrated in FIG. 3, the temporary holding section 15 is configured with respective components attached to a frame 20. FIG. 3 is a schematic side view of the temporary holding section 15 viewed from the left side, and some components, such as a motor and gears, have been omitted for ease of explanation.

The temporary holding section 15 is controlled overall by a controller 21. The controller 21 includes a CPU, not illustrated in the drawings, similarly to the main controller 9 and the banknote controller 11 (see FIG. 1). Working in conjunction with, for example, the banknote controller 11, the controller 21 reads and executes predetermined programs from ROM, flash memory or the like, not illustrated in the drawings, to perform various processing such as drum rotation and tape travel control, as well as determining the presence or absence of a banknote.

Inside the controller 21 is a data storage section (not illustrated in the drawings) configured by for example RAM and flash memory. The data storage section is stored with various data.

The temporary holding section 15 passes banknotes to and from the conveyance section 13 (see FIG. 2) using a passing section 22 provided at a front upper portion of the frame 20. The temporary holding section 15 uses a passing sensor 23 disposed to the rear of the passing section 22 to detect whether or not a banknote BL is present, and notifies the controller 21.

A substantially circular cylinder shaped drum 25 is provided in the vicinity of the center inside the frame 20 of the temporary holding section 15. A shaft 25X, that has a long, thin, circular columnar shape running in the left-right direction and that serves as an example of a central shaft, penetrates the drum 25. The drum 25 rotates together with the shaft 25X in a take up direction R1 and an unwind direction R2 under control of the controller 21.

Figure 4:
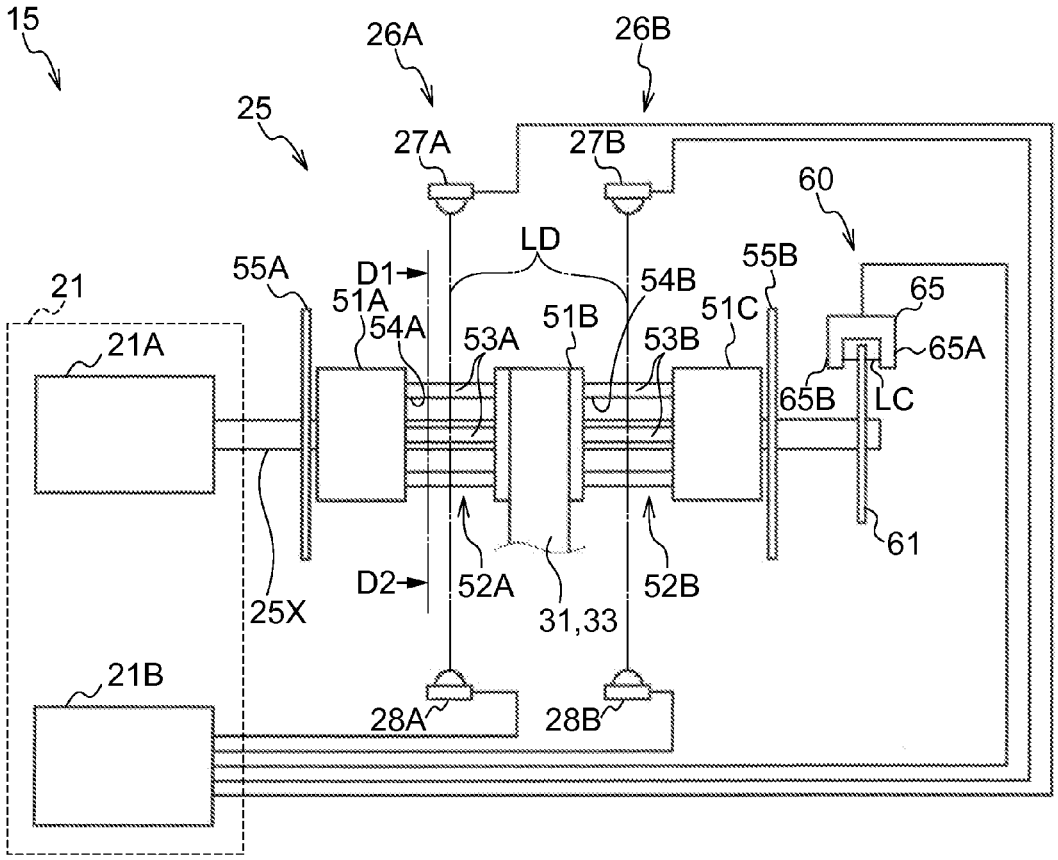
FIG. 4 is a schematic drawing illustrating a configuration (2) of a temporary holding section.

As illustrated in FIG. 4, rotation of the shaft 25X that serves as a rotation shaft is controlled by a drum drive controller 21A of the controller 21.

An outer reel 32 is disposed on an upper side and an inner reel 34 is disposed on a lower side at an inside rear portion of the frame 20 of the temporary holding section 15 (see FIG. 3). An outer tape 31 is taken up on the outer reel 32. An inner tape 33 is taken up on the inner reel 34. Note that the outer tape 31 and the inner tape 33 are examples of tapes.

The outer tape 31 and the inner tape 33 are each formed in a thin film shape using a predetermined resin material. The outer tape 31 and the inner tape 33 have sufficient length in the long direction, and have a short direction length (namely tape width) sufficiently shorter than the long edge of a banknote BL.

The inner tape 33 is pulled out from the inner reel 34, travels inside the frame 20 toward the front, is directed upwards by a roller 37, and is then directed upwards and toward the rear by a roller 38 that is disposed to the rear of the passing sensor 23. A leading end portion of the inner tape 33 is fixed to a circumferential side face of the drum 25.

The outer tape 31 is pulled out from the outer reel 32, travels inside the frame 20 toward the front, and is directed downwards and toward the rear by a roller 35 that is disposed to the rear of the passing sensor 23. A leading end portion of the outer tape 31 is fixed to the circumferential side face of the drum 25 overlapping with the leading end portion of the inner tape 33.

Accordingly, if the drum 25 of the temporary holding section 15 is rotated in the take up direction R1 in a state in which a banknote BL has been taken in through the passing section 22, the banknote BL is taken up between the outer tape 31 and the inner tape 33, as the outer tape 31 and the inner tape 33 are being respectively pulled out from the outer reel 32 and the inner reel 34. The temporary holding section 15 is thereby able to wind the outer tape 31, the inner tape 33, and the banknote BL around the circumferential side face of the drum 25 in this state.

In the following explanation, the outer tape 31, the inner tape 33, the outer reel 32, the inner reel 34, and the various rollers that move them are collectively referred to as the tape moving system.

1-3. Drum Configuration

As illustrated in FIG. 4, the drum 25 does not have a uniform circular cylinder shape, but is configured by an arrangement of plural portions along the shaft 25X.

Namely, the drum 25 includes short circular cylinder shaped circular cylinder portions 51A, 51B, 51C that are disposed along the shaft 25X with gaps between each other.

The outer tape 31 and the inner tape 33 described above are fixed to a circumferential side face of the circular cylinder portion 51B disposed at the center. The outer tape 31 and the inner tape 33 are wound up accompanying rotation of the drum 25.

The shaft 25X couples the circular cylinder portion 51A and the circular cylinder portion 51B, and the circular cylinder portion 51B and the circular cylinder portion 51C, together across the respective gaps therebetween, and the gaps may be regarded as being grooved shape as viewed from respective circumferential side faces. In the following explanation, the gap between the circular cylinder portion 51A and the circular cylinder portion 51B is referred to as the groove portion 52A, and the gap between the circular cylinder portion 51B and the circular cylinder portion 51C is referred to as the groove portion 52B.

Namely, the drum 25 is provided with the groove portions 52A and 52B along the shaft 25X, with one on each side of the winding location where the outer tape 31 and the inner tape 33 are wound on.

Plural plate shaped bridge portions 53A are attached to the groove portion 52A so as to span between the circular cylinder portion 51A and the circular cylinder portion 51B in the vicinity of the drum 25 circumferential side face.

Figure 5:
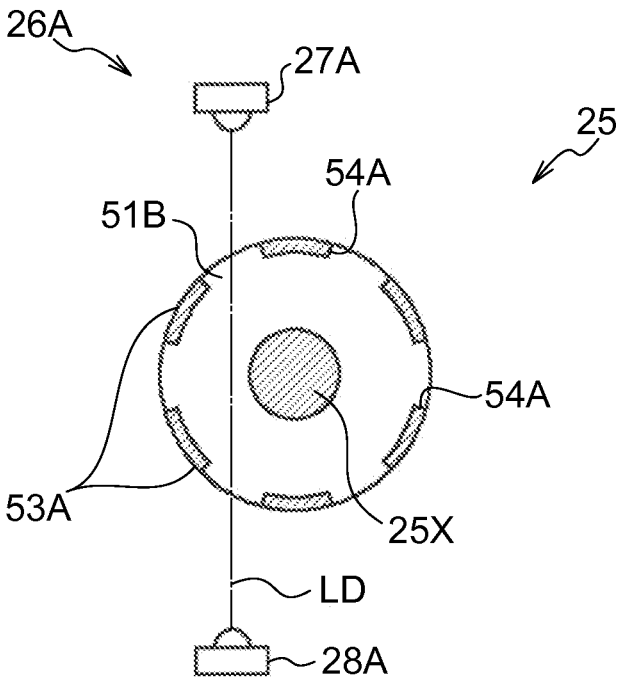
FIG. 5 is a cross-section illustrating a configuration of a drum and a detection unit.

FIG. 5 is a cross-section taken along line D1-D2 in FIG. 4. As illustrated in FIG. 5, six of the bridge portions 53A are disposed discretely at even intervals around the outer circumferential direction of the drum 25. Opening hole portions 54A are formed between mutually adjacent bridge portions 53A.

The opening hole portions 54A are in mutual communication with one another across a space to the inside of the bridge portions 53A. In particular, two opening hole portions 54A on either side of a given opening hole portion 54A, two skip-one opening hole portions 54A, are in linear communication with each other. Light can accordingly be made to pass straight through these two opening hole portions 54A.

Similarly to the groove portion 52A, the groove portion 52B is provided with six bridge portions 53B spanning between the circular cylinder portions 51B and 51C, with the bridge portions 53B disposed around the circumferential direction with opening hole portions 54B (see FIG. 4) interposed therebetween.

The drum 25 is thereby configured with the plural bridge portions 53A and 53B spanning the groove portions 52A and 52B that are formed between the respective circular cylinder shaped circular cylinder portions 51A, 51B and 51C.

Moreover, as illustrated in FIG. 4, guide plates 55A and 55B are attached to the shaft 25X at the outside of the circular cylinder portions 51A and 51C, namely on the opposite side of the circular cylinder portion 51A to the groove portion 52A side, and on the opposite side of the circular cylinder portion 51C to the groove portion 52B side. The guide plates 55A and 55B are configured in circular plate shapes and are larger in diameter than the circular cylinder portions 51A and 51C, and guide the banknotes BL.

The guide plates 55A and 55B guide the banknotes BL when winding the banknotes BL around the drum 25 circumferential side face. The banknotes BL are thus wound between the guide plates 55A and 55B, namely in a region from the circular cylinder portion 51A to the circular cylinder portion 51C.

Detection units 26A and 26B, that detect the presence or absence of a banknote BL, are respectively provided in the vicinity of the drum 25 at left-right direction positions corresponding to the groove portions 52A and 52B.

The detection units 26A and 26B respectively include light emitting portions 27A and 27B that emit drum detection light LD, and light receiving portions 28A and 28B that receive the drum detection light LD. The light emitting portions 27A and 27B and the light receiving portions 28A and 28B are respectively disposed facing each other across the drum 25, as illustrated in FIG. 5.

The light emitting portions 27A and 27B respectively emit drum detection light LD toward the groove portions 52A and 52B of the drum 25 under the control of a signal gauge 21B (see FIG. 4) of the controller 21.

As illustrated in FIG. 5, the light emitting portions 27A and 27B are disposed such that the light paths of the drum detection light LD pass to the inside of the groove portions 52A and 52B (see FIG. 4), these being locations closer to the shaft 25X than the outer periphery of the circular cylinder portions 51A, 51B, 51C (see FIG. 4).

The drum detection light LD reaches the opposite side of the drum 25 when the drum detection light LD passes through the opening hole portions 54A, due to the rotation angle of the drum 25. On the other hand, progression of the drum detection light LD is blocked when it is illuminated onto the bridge portions 53A.

The light receiving portions 28A and 28B receive drum detection light LD emitted from the light emitting portions 27A and 27B that has passed through the respective groove portions 52A and 52B (namely that has passed the opening hole portions 54A and 54B). The light receiving portions 28A and 28B generate and transmit to the signal gauge 21B (see FIG. 4) light reception signals according to light reception results.

The controller 21 identifies whether or not the drum detection light LD has been received by the light receiving portions 28A and 28B, based on the acquired light reception signals.

Namely, the controller 21 regards the opening hole portions 54A as not being blocked by a banknote BL when drum detection light LD is received even for an instant through a given opening hole portion 54A. The controller 21 regards the opening hole portions 54A and 54B as being blocked by a banknote BL if either one of the opening hole portions 54A and 54B is blocked, even when the opening hole portions 54A and 54B are not both blocked.

The groove portions 52A and 52B of the drum 25 are accordingly spanned by the bridge portions 53A and 53B, and banknotes BL are wound around the circumferential side faces of the circular cylinder portions 51A, 51B and 51C together with the outer tape 31 and the inner tape 33.

The detection units 26A and 26B of the drum 25 respectively illuminate the drum detection light LD toward the groove portions 52A and 52B and receive the drum detection light LD. The controller 21 determines the presence or absence of a banknote BL based on the light reception results.

1-4. Bridge Portion Conditions

Explanation follows regarding conditions for detecting the presence or absence of a banknote BL when a single banknote BL is wound onto the periphery of the drum 25, with explanation given separately regarding the circumferential direction and width direction.

1-4-1. Circumferential Direction Conditions

Figure 6:
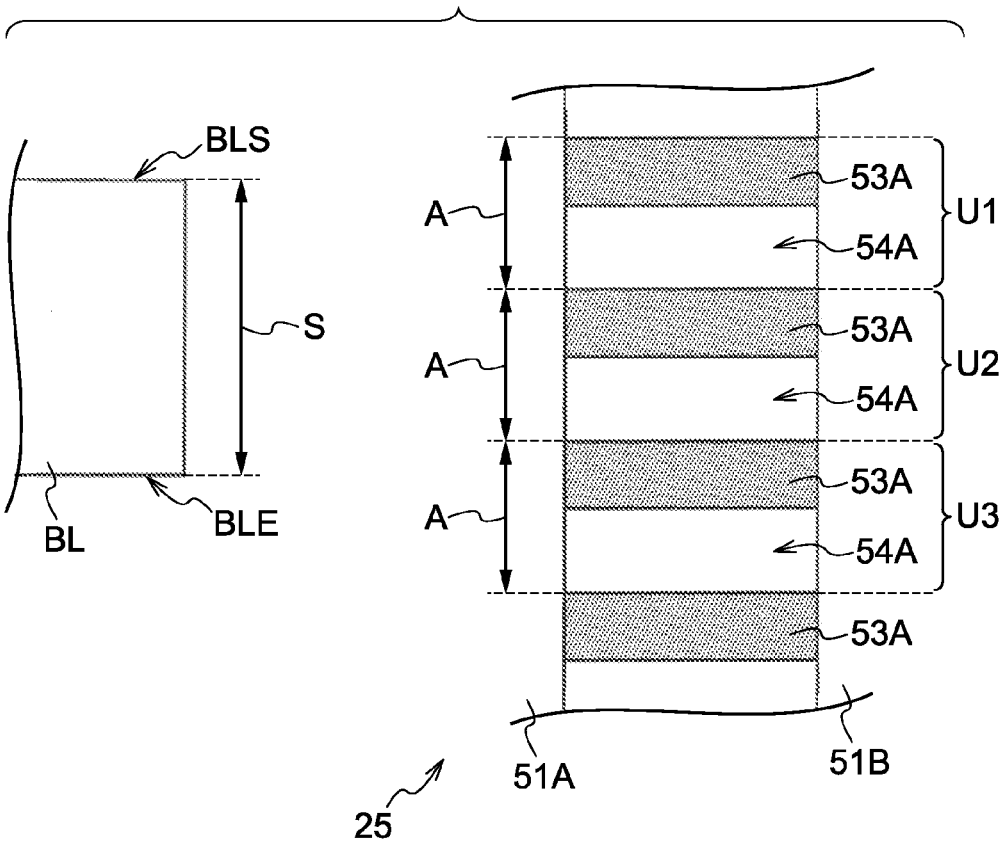
FIG. 6 is a schematic drawing illustrating a relationship between bridge portions and a banknote related to lengths along a circumferential direction.

As illustrated in FIG. 6, the short edge direction length of the banknote BL, namely the length of the banknote BL around the drum 25 circumferential direction, is denoted the banknote short edge length S. Note that FIG. 6 is a plan view illustrating the circumferential side face of the drum 25 when opened out flat, with the bridge portions 53A shaded with diagonal lines so as to be distinguishable from the opening hole portions 54A.

The length of one adjacent bridge portion 53A and opening hole portion 54A (referred to below as a bridge unit U) around the drum 25 circumferential direction is a value expressing a cycle of the bridge portions 53A around the circumferential direction, referred to below as a bridge cycle A.

Here, a case is considered in which a banknote BL is detected as a result of the drum detection light LD being blocked at the opening hole portion 54A of a bridge unit U2 that is at the center of consecutive bridge units U1 to U3.

Suppose a leading edge BLS of the banknote BL is at a given position within the range of the bridge unit U1. The condition for blocking of the opening hole portion 54A of the bridge unit U2 is that the trailing edge BLE of the banknote BL is never within the range of the bridge unit U2, namely that the trailing edge BLE is at a position in the bridge unit U3 or later.

Within the range satisfying this condition, the required shortest banknote short edge length S is when the leading edge BLS of the banknote BL is at the upper edge of the bridge unit U1, and the trailing edge BLE is at the upper edge of the bridge unit U3.

Namely, in order to satisfy this condition, the banknote short edge length S must be twice the bridge cycle A, or longer. Expressing the relationship to the bridge cycle A as a equation leads to the following Equation (1).

$$A \leq S/2 \qquad \text{Equation (1)}$$

Now consider the relationship between the number of bridge units U provided to the roller 35 (referred to below as the bridge number N) and Equation (1). Note that as described above, the actual bridge number N is six in the drum 25, however consider the generalized "bridge number N".

If the radius of the drum 25 is denoted R, then using the circumferential ratio 7E, the circumferential direction length of the drum 25 is $2\pi R$. On the other hand, the circumferential direction length of the drum 25 may also be expressed by the length of the bridge cycle A multiplied by the bridge number N. The drum 25 accordingly satisfies the following Equation (2).

$$2\pi R = A \cdot N \qquad \text{Equation (2)}$$

Substituting Equation (2) in Equation (1), and rearranging in terms of the bridge number N, gives the following Equation (3).

$$N \geq 4\pi R/S \qquad \text{Equation (3)}$$

Namely, for the circumferential direction length of the drum 25, setting the bridge number N to satisfy Equation (3), employing radius R and the banknote short edge length S, enables reliable detection of the presence or absence of a banknote BL.

1-4-2. Width Direction Conditions

Figure 7:
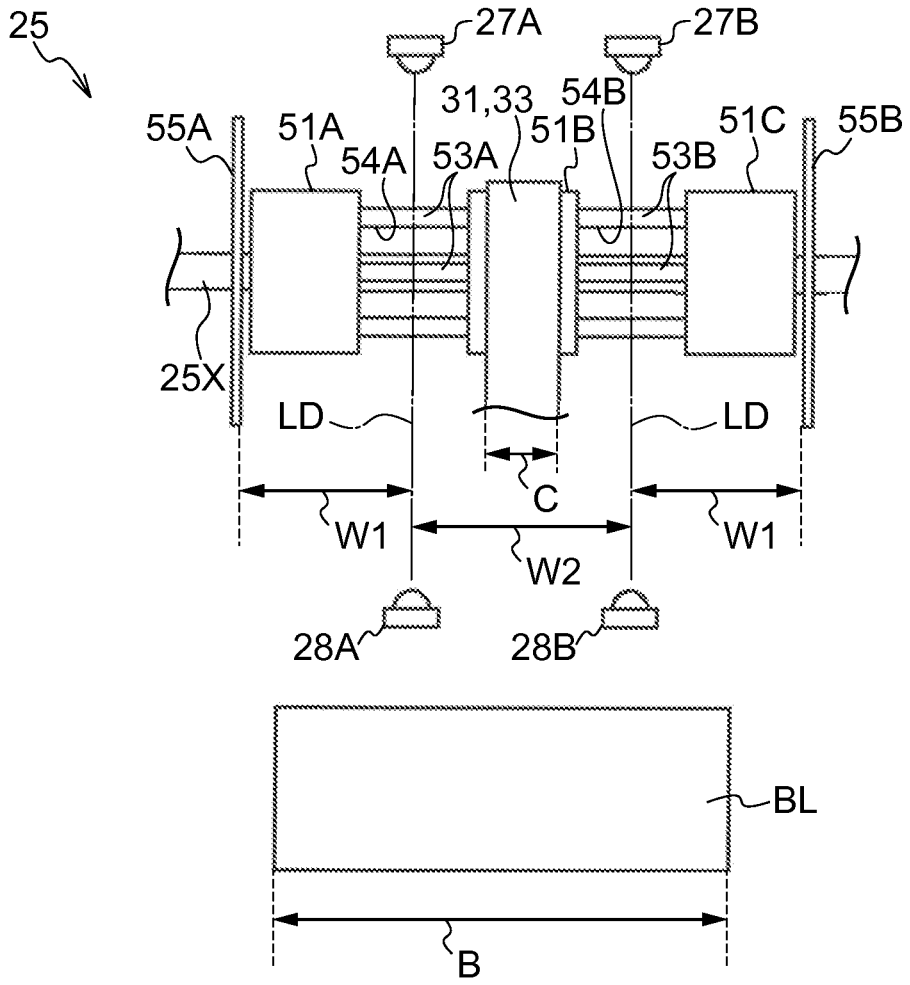
FIG. 7 is a schematic drawing illustrating a relationship between bridge portions and a banknote related to lengths along a width direction in a first exemplary embodiment.

As illustrated in FIG. 7, the long edge direction length of the banknote BL, namely the length of the banknote BL along the shaft 25X, this being the length in the drum 25 width direction, is denoted the banknote long edge length B.

The banknote long edge length B represents the shortest banknote long edge length B in cases in which plural types of banknotes BL with different banknote long edge lengths B are handled in the temporary holding section 15 (see FIG. 2).

In the drum 25, the length from the inside faces of the guide plates 55A and 55B to the nearest respective drum detection light LD light path is denoted a guidance separation W1. The separation between the drum detection light LD light paths is denoted a detection separation W2.

The width of the outer tape 31 and the inner tape 33 is denoted a tape width C. The tape width C is shorter than the banknote long edge length B, as described above.

Here, a case is considered in which a banknote BL is off-center in the temporary holding section 15 toward the guide plate 55A side (see FIG. 4). In such a case, the banknote BL is wound onto the circumferential side face of the drum 25 by the outer tape 31 and the inner tape 33, and it is necessary to satisfy the following Equation (4) in order to block the drum detection light LD.

$$W1 + C < B \qquad \text{Equation (4)}$$

Rearranging Equation (4) in terms of the guidance separation W1 gives the following Equation (5).

$$W1 < B - C \qquad \text{Equation (5)}$$

In order to detect the banknote BL with at least one of the two beams of drum detection light LD, it is necessary to set the detection separation W2 shorter than the banknote long edge length B, and also necessary to set the detection separation W2 longer than the tape width C. Expressed as an equation, this relationship satisfies the following Equation (6).

$$C < W2 < B \qquad \text{Equation (6)}$$

Namely, reliable detection can be made of the presence or absence of the banknote BL by satisfying Equation (5) and Equation (6) regarding the respective lengths of the banknote long edge length B, the tape width C, the guidance separation W1 and the detection separation W2 in the drum 25 width direction.

1-5. Circular Plate Unit Configuration

As illustrated in FIG. 4, the temporary holding section 15 is provided with a circular plate unit 60 that has the shaft 25X in common with the drum 25 and that serves as an example of a bridge position detection unit.

The circular plate unit 60 includes a circular plate 61 configured by a thin plate shaped circular plate. The circular plate 61 is attached to the shaft 25X to the outside of the guide plate 55B (distant as viewed from the circular cylinder portion 51B), with the axial center of the circular plate 61 aligned with the axial center of the shaft 25X.

The circular plate 61 accordingly rotates in synchronization with the bridge portions 53A and 53B and the opening hole portions 54A and 54B of the drum 25 during rotation of the shaft 25X.

Figure 8:
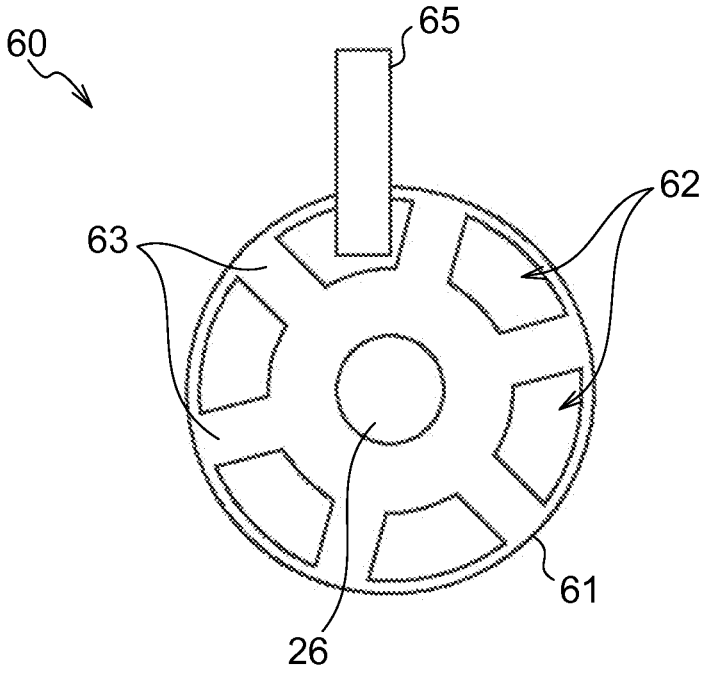
FIG. 8 is a schematic drawing illustrating a configuration of a circular plate unit.

As illustrated in FIG. 8, the circular plate 61 is formed with light blocking portions 63 at six locations by slits 62 piercing through at six locations at uniform intervals around a circle.

As illustrated in FIG. 4, the circular plate unit 60 is provided with a sensor portion 65. The sensor portion 65 is configured by a combination of a circular plate light emitting portion 65A and a circular plate light receiving portion 65B. The circular plate light emitting portion 65A emits circular plate detection light LC from one face side of the circular plate 61. The circular plate light receiving portion 65B receives the circular plate detection light LC at the opposite side of the circular plate 61.

The circular plate detection light LC reaches the circular plate light receiving portion 65B when the circular plate detection light LC emitted from the circular plate light emitting portion 65A passes through the slits 62 (see FIG. 8), serving as examples of pass-through portions. The circular plate detection light LC does not reach the circular plate light receiving portion 65B when blocked by the light blocking portions 63.

Similarly to the light receiving portions 28A and 28B, the sensor portion 65 generates and transmits, to the signal gauge 21B, a circular plate reception signal according to circular plate detection light LC reception results of the circular plate light receiving portion 65B.

The position and shape of the slits 62 (see FIG. 8) in the circular plate 61 are set so as to align with the respective positions of the opening hole portions 54A and 54B of the drum 25.

Namely, the cycles and phases of the circular plate unit 60 are aligned such that the circular plate detection light LC emitted from the circular plate light emitting portion 65A of the sensor portion 65 passes through the slits 62, when the drum detection light LD emitted from the light emitting portions 27A and 27B passes through the opening hole portions 54A and 54B.

As described above, the drum detection light LD is respectively blocked by each of the bridge portions 53A and 53B, or by a banknote BL, depending on the rotation angle of the drum 25 and the winding state of a banknote BL.

On the other hand, the circular plate unit 60 is disposed further to the outside than the guide plate 55B, and the circular plate light emitting portion 65A and the circular plate light receiving portion 65B of the sensor portion 65 are extremely close to one another. The likelihood of the circular plate detection light LC being blocked by anything other than the light blocking portions 63 is consequently extremely low.

The controller 21 determines that the drum detection light LD is being blocked by the bridge portions 53A and 53B when neither the drum detection light LD nor the circular plate detection light LC are being received. The controller 21 determines that the drum detection light LD is being blocked by a banknote BL when the drum detection light LD is not being received but the circular plate detection light LC is being received.

The temporary holding section 15 thereby employs the circular plate detection light LC light reception results, in addition to the drum detection light LD detection results, to determine whether or not there is a banknote BL wound onto the drum 25 circumferential side face.

1-6. Operation and Advantageous Effects

In the above configuration, in the temporary holding section 15 according to the first exemplary embodiment, the bridge portions 53A and 53B span along the shaft 25X direction across the groove portions 52A and 52B of the drum 25 at plural discrete locations around the circumferential direction.

The bridge portions 53A and 53B of the temporary holding section 15 can accordingly prevent the outer tape 31 and the inner tape 33 slipping off into the groove portion 52A or the groove portion 52B, even when the winding position of the outer tape 31 and/or the inner tape 33 becomes displaced in the width direction, during winding of the outer tape 31 and the inner tape 33 onto the circular cylinder portion 51B circumferential side face.

Namely, in the temporary holding section 15, the outer tape 31 and the inner tape 33 can be wound onto an equivalent circumferential side face to the circular cylinder portion 51B, thereby forestalling damage to the outer tape 31 and the inner tape 33 caused by the outer tape 31 and the inner tape 33 slipping off into the groove portion 52A or the groove portion 52B.

Moreover, in the temporary holding section 15, it is possible to prevent damage to the outer tape 31 and the inner tape 33 caused by the outer tape 31 and the inner tape 33 slipping off into the groove portion 52A or the groove portion 52B, even when the winding position of the outer tape 31 and the inner tape 33 becomes displaced as a result of slack during a maintenance operation to remove banknotes BL wound onto the drum 25, or to manually wind the outer tape 31 and the inner tape 33 onto the drum 25.

Moreover, the bridge portions 53A and 53B of the temporary holding section 15 are disposed discretely around the drum 25 circumferential direction, forming the opening hole portions 54A and 54B. The temporary holding section 15 is moreover configured such that the detection units 26A and 26B illuminate the drum detection light LD toward the groove portions 52A and 52B, with the drum detection light LD passing through the opening hole portions 54A and 54B.

The temporary holding section 15 is accordingly capable of detecting the presence or absence of a banknote BL based on the drum detection light LD light reception results.

The structure of the bridge portions 53A and 53B of the drum 25 causes the drum detection light LD to be blocked by the bridge portions 53A and 53B during rotation of the drum 25.

Regarding this point, the temporary holding section 15 is provided with the circular plate unit 60, with the slits 62 of the circular plate 61 that rotates in synchronization with the drum 25, aligned with the cycle and phases of the opening hole portions 54A and 54B. The temporary holding section 15 detects the presence or absence of the slits 62 in the sensor portion 65 with the circular plate detection light LC.

The controller 21 of the temporary holding section 15 uses the drum detection light LD light reception results, combined with the circular plate detection light LC detection results of the circular plate unit 60, to determine the presence or absence of a banknote BL.

The temporary holding section 15 is thus capable of accurately determining whether the cause of the drum detection light LD being blocked is the bridge portions 53A and 53B, or another cause (namely a banknote BL). The temporary holding section 15 can therefore reliably eliminate false detection of a banknote BL caused by the bridge portions 53A and 53B.

Rather than filling the groove portions 52 with a transparent material that allows the drum detection light LD to pass through, the drum 25 is configured with the opening hole portions 54A and 54B configuring empty spaces at circumferential direction gaps between the bridge portions 53A and 53B, allowing the drum detection light LD to pass through.

The temporary holding section 15 is accordingly capable of extremely high precision determination of the presence or absence of a banknote BL since it is possible to effectively eliminate issues that can occur when a transparent material is employed in the temporary holding section 15, such as a drop in detection precision due to refraction or reflection of the drum detection light LD, or false detection of a banknote BL due to the drum detection light LD being blocked by a foreign object such as dust or dirt adhering to the surface.

Moreover, the relationship between the circumferential direction length and bridge number N of the bridge portions 53A and 53B is set so as to satisfy Equation (3), and the width direction length of the bridge portions 53A and 53B is set so as to satisfy Equation (5) and Equation (6).

At least one location out of the opening hole portions 54A and 54B of the temporary holding section 15 can therefore be reliably blocked by a banknote BL, even when the banknote BL winding position on the drum 25 is displaced in the width direction or the circumferential direction.

Accordingly, in the temporary holding section 15 at least one out of the two beams of drum detection light LD can be reliably blocked by a banknote BL within a maximum of one revolution of the drum 25, regardless of the position of the banknote BL on the circumferential side face of the drum 25.

As a result, the temporary holding section 15 is capable of reliably detecting the presence of a banknote BL based on drum detection light LD light reception results even when only a single banknote BL is wound onto the drum.

According to the above configuration, in the temporary holding section 15 of the first exemplary embodiment the bridge portions 53A and 53B span along the shaft 25X direction across the groove portions 52A and 52B of the drum 25 at plural discrete locations around the circumferential direction. The outer tape 31 and the inner tape 33 can accordingly be prevented from slipping off into the groove portions 52A and 52B in the temporary holding section 15, enabling damage to the outer tape 31 and the inner tape 33 to be forestalled. Similarly to hitherto, the temporary holding section 15 is capable of precisely determining the presence or absence of a banknote BL, based on the detection results of the drum detection light LD that the detection units 26A and 26B illuminate toward the groove portions 52A and 52B and that passes through the opening hole portions 54A and 54B.

2. Second Exemplary Embodiment

2-1. Temporary Holding Section Configuration

Figure 9:
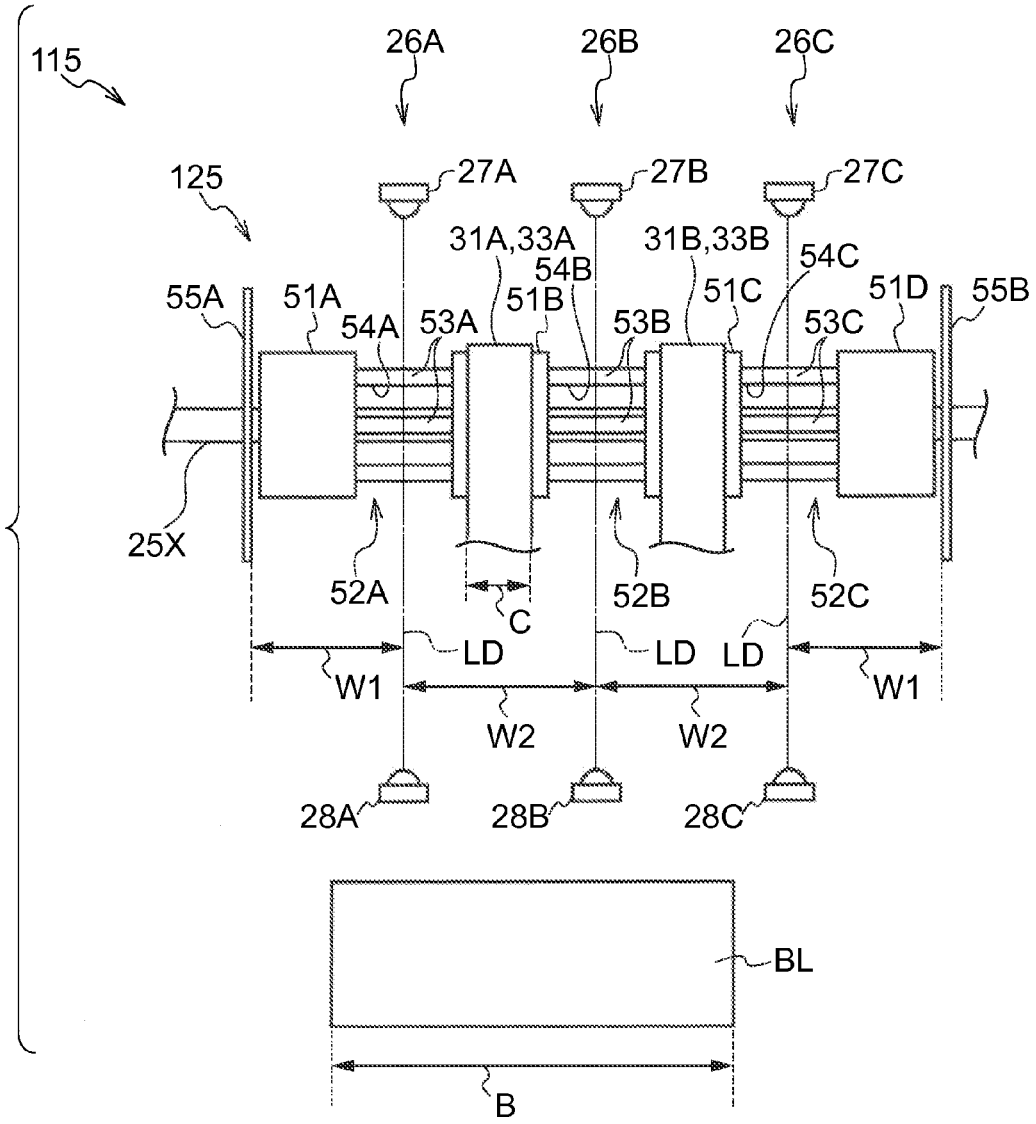
FIG. 9 is a schematic drawing illustrating a configuration of a temporary holding section according to a second exemplary embodiment.

Portions in FIG. 9 that correspond to FIG. 4 and FIG. 7 are allocated the same reference numerals thereto. As illustrated in FIG. 9, a temporary holding section 115 of a second exemplary embodiment differs from the temporary holding section 15 of the first exemplary embodiment in the point that two outer tapes and two inner tapes are respectively provided, namely in the point that two tape moving systems are provided.

The temporary holding section 115 includes a drum 125 in place of the drum 25 to accommodate the two tape moving systems.

The temporary holding section 115 includes outer tapes 31A and 31B and inner tapes 33A and 33B, respectively configured similarly to the outer tape 31 and inner tape 33 of the first exemplary embodiment.

Note that although not illustrated in the drawings, in the temporary holding section 115 respective tape moving system configuration components including outer reels 32 and inner reels 34 are provided to configure the two tape moving systems.

2-2. Drum Configuration

As illustrated in FIG. 9, the drum 125 is configured by adding an extra width direction stage to the drum 25 of the first exemplary embodiment.

Namely, the drum 125 is provided with a circular cylinder portion 51D penetrated by the shaft 25X similarly to the circular cylinder portions 51A, 51B and 51C. A groove portion 52C is formed between the circular cylinder portion 51C and the circular cylinder portion 51D.

In the drum 125, the outer tape 31A and the inner tape 33A are wound onto the circular cylinder portion 51B, and the outer tape 31B and the inner tape 33B are wound onto the circular cylinder portion 51C.

Similarly to at the groove portions 52A and 52B, six plate shaped bridge portions 53C are attached to the groove portion 52C discretely and at even intervals so as to span between the circular cylinder portions 51C and 51D. Opening hole portions 54C are formed between the respective bridge portions 53C.

In addition to the detection units 26A and 26B that respectively correspond to the groove portions 52A and 52B, a detection unit 26C is provided corresponding to the groove portion 52C in the vicinity of the drum 125. The detection unit 26C includes a light emitting portion 27C corresponding to the light emitting portions 27A and 27B, and a light receiving portion 28C corresponding to the light receiving portions 28A and 28B.

Drum detection light LD emitted from the light emitting portion 27C toward the groove portion 52C is received by the light receiving portion 28C when it passes through the opening hole portions 54C.

The controller 21 identifies whether or not the drum detection light LD has been detected based on light reception signals acquired from the light receiving portions 28A, 28B and 28C. Here, the controller 21 considers the light to have been blocked by a banknote BL when at least one location is blocked, even when not all of the opening hole portions 54A, 54B and 54C are blocked.

The drum 125 moreover satisfies similar circumferential direction and width direction conditions to the drum 25 of the first exemplary embodiment for detection of whether or not a banknote BL is wound onto the circumferential side face.

Namely, in the circumferential direction the bridge number N, the radius R and the banknote short edge length S of the drum 125 are set so as to satisfy Equation (3) described above. In the drum 125 width direction, the banknote long edge length B, the tape width C, the guidance separation W1 and the detection separation W2 are set so as to satisfy Equation (5) and Equation (6) described above.

The bridge portions 53A, 53B and 53C of the drum 125 respectively span the three groove portions 52A, 52B and 52C to accommodate the two tape moving systems. Moreover, the detection units 26A, 26B and 26C of the drum 125 are configured so as to illuminate and receive the drum detection light LD.

2-2. Operation and Advantageous Effects

In the temporary holding section 115 of the second exemplary embodiment configured as described above, the respective bridge portions 53A, 53B and 53C span along the shaft 25X direction across the groove portions 52A, 52B and 52C of the drum 125 at plural discrete locations around the circumferential direction.

The temporary holding section 115 thereby, when the outer tape 31A and the inner tape 33A are wound onto the circumferential side face of the circular cylinder portion 51B, and the outer tape 31B and the inner tape 33B are wound onto the circumferential side face the circular cylinder portion 51C or during a maintenance operation, even if the winding position of the outer tape 31A, the inner tape 33A, the outer tape 31B and the inner tape 33B becomes displaced in the width direction, the bridge portions 53A, 53B and 53C can prevent the outer tape 31A, the inner tape 33A, outer tape 31B and the inner tape 33B from slipping off into the groove portions 52A, 52B and 52C.

Moreover, similarly to in the first exemplary embodiment, the bridge portions 53A, 53B and 53C are set such that the circumferential direction length and bridge number N respectively satisfy Equation (3), and such that the respective width direction lengths satisfy Equation (5) and Equation (6).

At least one location out of the opening hole portions 54A, 54B and 54C of the temporary holding section 115 can therefore be reliably blocked by a banknote BL, even when the banknote BL winding position on the drum 125 is displaced in the width direction or the circumferential direction.

Accordingly, in the temporary holding section 115 at least one out of the three beams of drum detection light LD can be reliably blocked by a banknote BL within a maximum of one revolution of the drum 125, regardless of the position of the banknote BL on the circumferential side face of the drum 125.

As a result, the temporary holding section 115 is capable of reliably detecting the presence of a banknote BL based on drum detection light LD light reception results even when only a single banknote BL is wound onto the drum, similarly to in the first exemplary embodiment.

The temporary holding section 115 also enables similar operation and advantageous effects to the first exemplary embodiment in other respects.

According to the above configuration, in the temporary holding section 115 according to the second exemplary embodiment, the bridge portions 53A, 53B and 53C span along the shaft 25X direction across the groove portions 52A, 52B and 52C of the drum 125 at plural discrete locations around the circumferential direction. The outer tapes 31A and 31B and the inner tapes 33A and 33B can accordingly be prevented from slipping off into the groove portions 52A, 52B and 52C in the temporary holding section 115. The temporary holding section 115 can accordingly forestall damage to the outer tapes 31A and 31B and the inner tapes 33A and 33B. In the temporary holding section 115, the respective beams of drum detection light LD shone toward the groove portions 52A, 52B and 52C pass through the opening hole portions 54A, 54B and 54C. Based on the detection results, the temporary holding section 115 is able to precisely determine the presence or absence of a banknote BL similarly to hitherto.

3. Third Exemplary Embodiment

3-1. Temporary Holding Section Configuration

Figure 10:
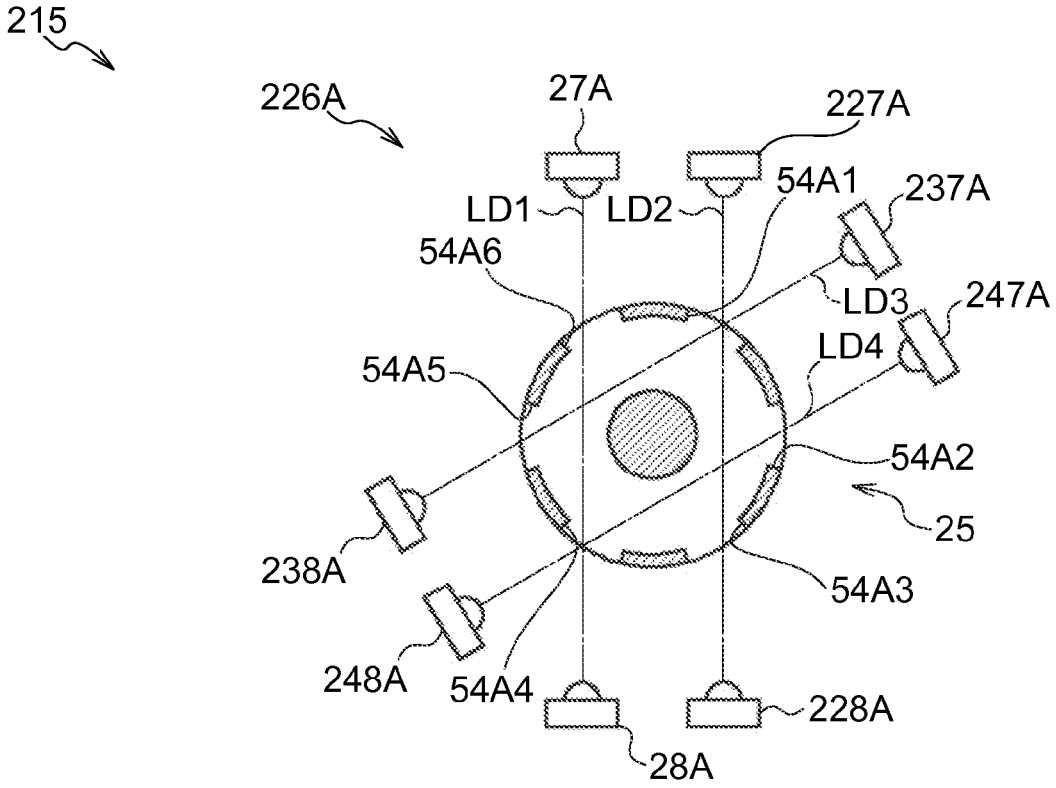
FIG. 10 is a schematic drawing illustrating a configuration of a detection unit according to a third exemplary embodiment.

Portions in FIG. 10 that correspond to FIG. 5 are allocated the same reference numerals thereto. As illustrated in FIG. 10, a temporary holding section 215 according to a third exemplary embodiment differs significantly from the temporary holding section 15 of the first exemplary embodiment in that the number of light emitting portions and light reception portions are increased, with plural light paths.

In the temporary holding section 215, detection unit 226A, and detection unit 226B (not illustrated in the drawings), corresponding to the detection units 26A and 26B, are provided at left-right direction positions corresponding to the groove portions 52A and 52B.

The detection unit 226B is of similar configuration to the detection unit 226A, and so the following explanation focuses on the detection unit 226A, with some explanation of the detection unit 226B omitted. In FIG. 10, working clockwise, six opening hole portions 54A, serving as examples of pass-through portions, are defined in sequence as opening hole portions 54A1, 54A2, 54A3, 54A4, 54A5 and 54A6.

The detection unit 226A is provided with light emitting portions 227A, 237A, and 247A in addition to the light emitting portion 27A, and is also provided with light receiving portions 228A, 238A and 248A in addition to the light receiving portion 28A.

Similarly to in the first exemplary embodiment, the light emitting portion 27A and the light receiving portion 28A are disposed facing each other across the drum 25 at positions where a drum detection light LD1 passes in sequence through the opening hole portions 54A6 and 54A4.

The light emitting portion 227A and the light receiving portion 228A are disposed facing each other across the drum 25 at positions where drum detection light LD2 passes in sequence through the opening hole portions 54A1 and 54A3. Namely, the light emitting portion 227A and the light receiving portion 228A are disposed such that the light path of the drum detection light LD2 is substantially parallel to the light path of the drum detection light LD1.

The light emitting portion 237A and the light receiving portion 238A are disposed facing each other across the drum 25 at positions where drum detection light LD3 passes in sequence through the opening hole portions 54A1 and 54A5. Namely, the light emitting portion 237A and the light receiving portion 238A are disposed such that the light path of the drum detection light LD3 forms an angle of approximately 60 degrees with respect to the light paths of the drum detection lights LD1 and LD2.

The light emitting portion 247A and the light receiving portion 248A are disposed facing each other across the drum 25 at positions where drum detection light LD4 passes in sequence through the opening hole portions 54A2 and 54A4. Namely, the light emitting portion 247A and the light receiving portion 248A are disposed such that the light path of the drum detection light LD4 is substantially parallel to the light path of the drum detection light LD3, and forms an angle of approximately 60 degrees with respect to the light of paths of the drum detection lights LD1 and LD2.

In the detection unit 226A, either one or two of the light paths of the respective drum detection lights LD1 to LD4 accordingly pass through the respective opening hole portions 54A1 to 54A6 of the groove portion 52A.

The controller 21 accordingly determines that at least one location out of the opening hole portions 54A1 to 54A6 is blocked by a banknote BL when at least one of the drum detection lights LD1 to LD4 cannot be detected by the respective light receiving portions 28A, 228A, 238A and 248A. Namely, the controller 21 is able to determine that one or more banknotes BL is wound onto the circumferential side face of the drum 25.

In the detection unit 226A, the points at which the drum detection lights LD1 to LD4 pass through the outer peripheral face of the drum 25 are spaced at intervals of exactly ⅙ the circumferential direction.

In the temporary holding section 215, the detection unit 226A illuminates the four beams of drum detection LD1 to LD4 at the same time, thereby enabling the presence or absence of blocking by a banknote BL to be detected for at the same time at the six opening hole portions 54A1 to 54A6.

3-2. Operation and Advantageous Effects

Similarly to in the first exemplary embodiment, in the temporary holding section 215 according to the third exemplary embodiment configured as above, the bridge portions 53A and 53B respectively span along the shaft 25X direction across the groove portions 52A and 52B of the drum 25 at plural discrete locations around the circumferential direction.

Similarly to in the first exemplary embodiment, in the temporary holding section 215 the bridge portions 53A and 53B can prevent the outer tape 31 and the inner tape 33 from slipping off into the groove portion 52A or the groove portion 52B, even when the winding position of the outer tape 31 and the inner tape 33 becomes displaced in the width direction during winding of the outer tape 31 and the inner tape 33 onto the circular cylinder portion 51B circumferential side face or during a maintenance operation.

Moreover, at the groove portion 52A of the temporary holding section 215, the light emitting portions 27A, 227A, 237A and 247A of the detection unit 226A emit the respective drum detection lights LD1 to LD4 at the same time. The light receiving portions 28A, 228A, 238A and 248A of the temporary holding section 215 receive, in parallel, the drum detection lights LD1 to LD4 that have respectively passed through the six opening hole portions 54A1 to 54A6.

Setting the bridge number N of the drum 25 to six enables the drum detection lights LD1 to LD4 to be illuminated through one of the opening hole portions 54A1 to 54A6 within a maximum of approximately ⅙ of a revolution, even allowing for blocking by the bridge portions 53A.

The temporary holding section 215 enables determination as to whether or not the drum detection lights LD1 to LD4 have been blocked at any of the six opening hole portions 54A1 to 54A6 to be made within approximately ⅙ of a revolution of the drum 25. The temporary holding section 215 thereby enables determination of whether or not a banknote BL has been wound on.

The temporary holding section 215 can accordingly achieve a significant reduction in the length of time required to make determination in comparison to the first exemplary embodiment, in which up to approximately one revolution of the drum 25 is required to determine the presence or absence of a banknote BL.

In other respects, the temporary holding section 215 is moreover capable of obtaining similar operation and advantageous effects to those of the temporary holding section 15 of the first exemplary embodiment.

According to the above configuration, in the temporary holding section 215 according to the third exemplary embodiment the respective bridge portions 53A and 53B span along the shaft 25X direction across the groove portions 52A and 52B of the drum 25 at plural discrete locations around the circumferential direction. The temporary holding section 215 can accordingly prevent the outer tape 31 and the inner tape 33 from slipping off into the groove portions 52A or 52B, enabling damage to the outer tape 31 and the inner tape 33 to be forestalled. In the temporary holding section 215, the drum detection lights LD1 to LD4 that are illuminated at the same time toward the groove portion 52A pass through the opening hole portions 54A1 to 54A6. Based on the detection results of the drum detection lights LD1 to LD4, the temporary holding section 215 is accordingly capable of precisely determining the presence or absence of a banknote BL in an extremely short space of time.

4. Fourth Exemplary Embodiment 4-1. Temporary Holding Section Configuration

Figure 11:
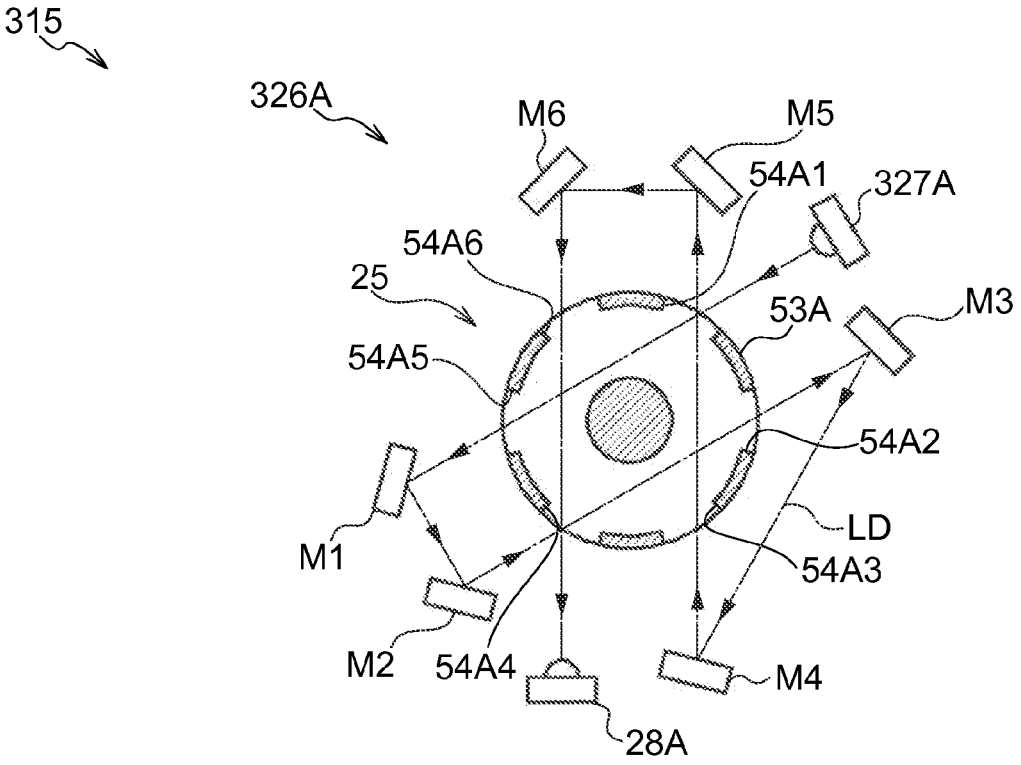
FIG. 11 is a schematic drawing illustrating a configuration of a detection unit according to a fourth exemplary embodiment.

Portions in FIG. 11 that correspond to FIG. 5 and FIG. 10 are allocated the same reference numerals thereto. As illustrated in FIG. 11, a temporary holding section 315 according to a fourth exemplary embodiment differs significantly from the temporary holding section 215 of the third exemplary embodiment in the point that the numbers of light emitting portions and light receiving portions are reduced, and mirrors are provided.

In the temporary holding section 315, detection unit 326A and detection unit 326B (not illustrated in the drawings), corresponding to the respective detection units 26A and 26B, are respectively provided at left-right direction positions corresponding to the groove portions 52A and 52B.

Note that the detection unit 326B is of similar configuration to the detection unit 326A, and so the following explanation focuses on the detection unit 326A, with some explanation of the detection unit 326B omitted.

The detection unit 326A includes: a light emitting portion 327A instead of the light emitting portion 27A; a light receiving portion 28A; and six mirrors M1, M2, M3, M4, M5 and M6 that reflect drum detection light LD.

The light emitting portion 327A is disposed at the position of the light emitting portion 237A of the third exemplary embodiment, and emits the drum detection light LD toward the groove portion 52A of the drum 25. The drum detection light LD proceeds along a similar light path to the drum detection light LD3 of the third exemplary embodiment, passing through the opening hole portion 54A1 and the opening hole portion 54A5 to be incident on the minor M1.

The minor M1 is disposed at a similar position to the light receiving portion 238A of the third exemplary embodiment, and is adjusted such that the reflective face of the minor M1 faces about halfway between the light emitting portion 327A and the minor M2. After passing through the opening hole portions 54A1 and 54A5, the drum detection light LD emitted from the light emitting portion 327A is therefore reflected by the mirror M1 and proceeds toward the minor M2.

The minor M2 is disposed at a position similar to the light receiving portion 248A of the third exemplary embodiment, and is set up such that the reflective face of the mirror M2 faces about halfway between the minor M1 and the minor M3. The drum detection light LD reflected by the mirror M1 is accordingly reflected by the minor M2 and passes in sequence through the opening hole portions 54A4 and 54A2, advancing along a light path similar but in the opposite direction to the light path of the drum detection light LD4 of the third exemplary embodiment, and is incident on the minor M3.

The minor M3 is disposed at a position similar to the light emitting portion 247A of the third exemplary embodiment, and is set up such that the reflective face of the mirror M3 faces about halfway between the minor M2 and the minor M4. After passing in sequence through the opening hole portions 54A4 and 54A2, the drum detection light LD reflected by the minor M2 is accordingly reflected by the minor M3 and proceeds toward the mirror M4.

The minor M4 is disposed at a position similar to the light receiving portion 228A of the third exemplary embodiment, and is set up such that the reflective face of the mirror M2 faces about halfway between the minor M3 and the minor M5. The drum detection light LD reflected by the mirror M3 is accordingly reflected by the minor M4 and passes in sequence through the opening hole portions 54A3 and 54A1, advancing along a light path similar, but in the opposite direction, to the light path of the drum detection light LD2 of the third exemplary embodiment, and is incident on the minor M5.

The minor M5 is disposed at a position similar to the light emitting portion 227A of the third exemplary embodiment, and is set up such that the reflective face of the mirror M5 faces about halfway between the minor M4 and the minor M6. After passing in sequence through the opening hole portions 54A3 and 54A1, the drum detection light LD reflected by the minor M4 is accordingly reflected by the minor M5, and is incident on the mirror M6.

The minor M6 is disposed at a position similar to the light emitting portion 27A of the third exemplary embodiment, and is set up such that the reflective face of the mirror M6 faces about halfway between the minor M5 and the light receiving portion 28A. The drum detection light LD reflected by the mirror M5 is accordingly reflected by the minor M6 and proceeds along a light path similar to that of the drum detection light LD1 of the third exemplary embodiment, passing in sequence through the opening hole portions 54A6 and 54A4 before being received by the light receiving portion 28A.

In the detection unit 326A, the drum detection light LD emitted from the light emitting portion 327A is accordingly reflected in sequence by the minors M1 to M6. In the detection unit 326A, the single beam of drum detection light LD accordingly proceeds along light paths similar to those of the drum detection lights LD1 to LD4 of the third exemplary embodiment to be received by the light receiving portion 28A.

Namely, after being emitted from the light emitting portion 327A, the drum detection light LD is reflected by the mirrors M1 to M6, so as to be illuminated onto the light receiving portion 28A after passing in sequence through each of the opening hole portions 54A1 to 54A6.

4-2. Operation and Advantageous Effects

Similarly to in the first exemplary embodiment, in the temporary holding section 315 according to the fourth exemplary embodiment configured as described above, the bridge portions 53A and 53B respectively span along the shaft 25X direction across the groove portions 52A and 52B of the drum 25 at plural discrete locations around the circumferential direction.

Similarly to in the first exemplary embodiment, in the temporary holding section 315 the bridge portions 53A and 53B can accordingly prevent the outer tape 31 and the inner tape 33 from slipping off into the groove portion 52A or the groove portion 52B, even when the winding position of the outer tape 31 and the inner tape 33 becomes displaced in the width direction during winding of the outer tape 31 and the inner tape 33 onto the circumferential side face of the circular cylinder portion 51B, or during a maintenance operation.

In the temporary holding section 315, at the groove portion 52A the drum detection light LD is emitted from the light emitting portion 327A of the detection unit 326A. In the temporary holding section 315, the drum detection light LD is reflected in sequence by the mirrors M1 to M6 and received by the light receiving portion 28A after passing through each of the opening hole portions 54A1 to 54A6.

In the temporary holding section 315, similarly to in the third exemplary embodiment, it is possible to detect whether or not the drum detection light LD is being blocked by a banknote at any of the six opening hole portions 54A1 to 54A6 by rotating the drum 25 through approximately just ⅙ of a revolution. Namely, the temporary holding section 315 is capable of detecting whether or not a banknote BL has been wound on.

In particular, the temporary holding section 315 only employs a single light emitting portion 327A and light receiving portion 28A, yet detects whether or not any of the opening hole portions 54A1 to 54A6 has been closed off by a banknote BL in a similar manner to the third exemplary embodiment employing four each of the light emitting portions and the light receiving portions.

Since a single light reception signal generated by the light receiving portion 28A is sufficient for the controller 21 to determine the presence or absence of a banknote BL, there is no need for computation processing of plural light reception signals such as in the third exemplary embodiment.

Although in the detection unit 326A the length of the light path of the drum detection light LD is longer than in the third exemplary embodiment, since the drum detection light LD travels at the speed of light there are no practical concerns of a delay.

The temporary holding section 315 thereby enables a significant reduction in the number of the comparatively expensive light emitting portions and light receiving portions compared to the third exemplary embodiment. Accompanying this, the temporary holding section 315 also enables a significant reduction in the wiring and in the number of signals that require processing in the controller, thus greatly simplifying the configuration whilst obtaining equivalent advantageous effects. Component and manufacturing costs can accordingly be kept low.

In other respects, the temporary holding section 315 obtains similar operation and advantageous effects to the temporary holding section 15 of the first exemplary embodiment.

In the temporary holding section 315 according to the fourth exemplary embodiment configured as described above, the bridge portions 53A and 53B span along the shaft 25X direction across the groove portions 52A and 52B of the drum 25 at plural discrete locations around the circumferential direction. The temporary holding section 315 can accordingly prevent the outer tape 31 and the inner tape 33 from slipping off into the groove portions 52A or 52B, enabling damage to the outer tape 31 and the inner tape 33 to be forestalled. Moreover, in the temporary holding section 315, the drum detection light LD that is illuminated toward the groove portion 52A is reflected in sequence by the mirrors M1 to M6 such that the drum detection light LD passes through each of the opening hole portions 54A1 to 54A6. The presence or absence of a banknote BL can thereby be precisely determined within an extremely short space of time with a simple configuration, based on the drum detection light LD detection results.

5. Fifth Exemplary Embodiment

5-1. Temporary Holding Section Configuration

Figure 12:
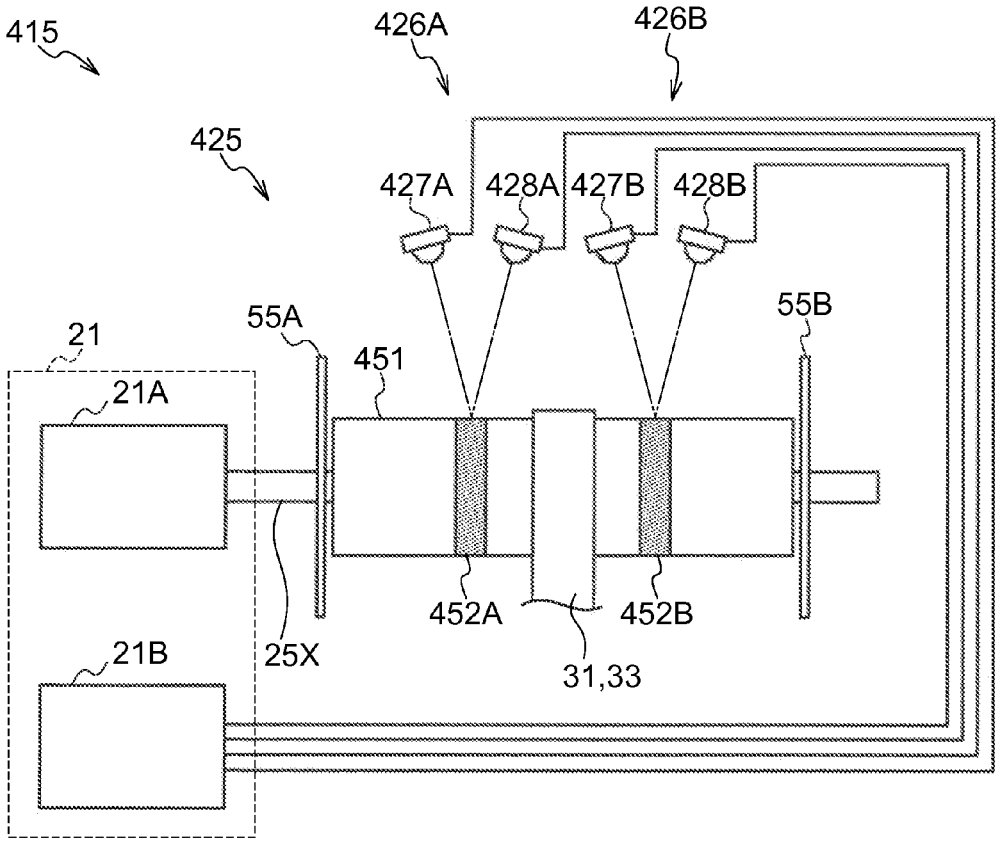
FIG. 12 is a schematic drawing illustrating a configuration of a temporary holding section according to a fifth exemplary embodiment.

Portions in FIG. 12, that correspond to portions in FIG. 4 are allocated the same reference numerals thereto. As illustrated in FIG. 12, a temporary holding section 415 according to a fifth exemplary embodiment differs significantly from the temporary holding section 15 of the first exemplary embodiment in the configuration of the drum and in the placement of light emitting portions and light receiving portions in a detection unit.

Namely, the temporary holding section 415 includes a drum 425 and detection units 426A and 426B instead of the drum 25 and the detection units 26A and 26B of the first exemplary embodiment.

The drum 425 includes a circular cylinder portion 451 with a uniform circular cylinder shape, and is not formed with the groove portions 52A and 52B or the bridge portions 53A and 53B (see FIG. 4). However, strip shaped reflective portions 452A and 452B that reflect light are formed encircling the drum 425 at locations equivalent to the groove portions 52A and 52B (see FIG. 4).

Note that the reflective portions 452A and 452B are, for example, configured by adhering reflective tape to an outer peripheral face of the circular cylinder portion 451.

The detection units 426A and 426B respectively include light emitting portions 427A and 427B that emit drum detection light LD, and light receiving portions 428A and 428B that receive the drum detection light LD.

The position and direction of the light emitting portion 427A are set so as to illuminate the drum detection light LD toward the reflective portion 452A. The light receiving portion 428A is disposed at a shaft 25X direction position symmetrical to the light emitting portion 427A about the reflective portion 452A.

Namely, the detection unit 426A is configured such that drum detection light LD emitted from the light emitting portion 427A is reflected by the reflective portion 452A, and the reflected drum detection light LD is received by the light receiving portion 428A.

The detection unit 426B is of similar configuration to the detection unit 426A, with the drum detection light LD reflected by the reflective portion 452B.

In the temporary holding section 415, the reflective portions 452A and 452B are covered when a banknote BL is wound on to the drum 425 such that the drum detection light LD cannot be reflected. When this occurs, the light receiving portions 428A and 428B of the detection units 426A and 426B are no longer able to receive the drum detection light LD.

The controller 21 accordingly determines that there are no banknotes BL wound around the drum 425 when the light receiving portions 428A and 428B are able to receive the drum detection light LD continuously over the course of approximately one revolution of the drum 425. The controller 21 determines that a banknote BL has been wound on when at least one out of the light receiving portions 428A and 428B becomes temporarily incapable of receiving light.

Accordingly, in the temporary holding section 415, the drum detection light LD is reflected by the reflective portions 452A and 452B of the drum 425. In the temporary holding section 415, the presence or absence of a banknote BL is determined according to reception of the reflected drum detection light LD by the light receiving portions 428A and 428B.

5-2. Operation and Advantageous Effects

According to the above configuration, in the temporary holding section 415 according to the fifth exemplary embodiment, the strip shaped reflective portions 452A and 452B are provided to the drum 425 and reflect the emitted drum detection light LD of the respective detection units 426A and 426B.

The temporary holding section 415 is accordingly capable of determining whether or not a banknote BL is wound onto the drum 425 based on whether or not reflected drum detection light LD is received by the detection units 426A and 426B.

Namely, since the banknotes BL are configured from paper and generally exhibit low reflectivity to light, even a single banknote BL wound onto the drum 425 can reliably stop reflection of the drum detection light LD at a portion of the reflective portions 452A and 452B. The temporary holding section 415 can accordingly use the fact that banknotes BL do not reflect the drum detection light LD to precisely detect a banknote BL.

The drum 425 does not include the groove portions 52A and 52B (see FIG. 4) of the drum 25 of the first exemplary embodiment. Accordingly, in the drum 425 the outer tape 31 and the inner tape 33 will not slip off even when the winding position of the outer tape 31 and the inner tape 33 becomes displaced in the width direction, such that in principle the outer tape 31 and the inner tape 33 do not sustain damage.

Moreover, components such as the groove portions 52A and 52B, the bridge portions 53A and 53B and the circular plate unit 60 (see FIG. 4) are rendered unnecessary in the drum 425, enabling a simpler structure than the drum 25 of the first exemplary embodiment. The simple manufacture of the drum 425 enables a significant reduction to be achieved in, for example, manufacturing costs of the drum 425.

The drum 425 of the temporary holding section 415 according to the fifth exemplary embodiment configured as described above is provided with the strip shaped reflective portions 452A and 452B. In the temporary holding section 415, the drum detection light LD emitted by the respective detection units 426A and 426B is reflected by the reflective portions 452A and 452B. The temporary holding section 415 is accordingly capable of determining whether or not a banknote BL has been wound on to the drum 425 based on whether or not reflected drum detection light LD is received by the detection units 426A and 426B.

6. Other Exemplary Embodiments

Note that in the first exemplary embodiment described above, explanation is given regarding a case in which the bridge number N of the drum 25 is six.

The present invention is however not limited thereto, and the bridge number N may be five or fewer, or may be seven or more. In such cases, a banknote BL can be reliably detected as long as the radius R and the banknote short edge length S satisfy Equation (3). This also applies to the second to the fourth exemplary embodiments.

In the first exemplary embodiment described above, explanation is given regarding a case in which the groove portions 52A and 52B are provided to the drum 25 at two locations, and the bridge portions 53A and 53B span across the respective groove portions 52A and 52B.

The present invention is however not limited to such a configuration, and, for example, the groove portion 52B and the bridge portions 53B may be omitted, with only the groove portion 52A and the bridge portions 53A provided. This also applies to the second to the fourth exemplary embodiments.

Moreover, in the first exemplary embodiment described above, explanation is given regarding a case employing one each of the outer tape and the inner tape.

The present invention is however not limited thereto, and may employ two each of the outer tapes and inner tapes, as described in the second exemplary embodiment. Alternatively, the present invention may employ three or more of the respective outer tapes and inner tapes. In such cases, groove portions may be provided along the shaft 25X direction between, and on the two sides of, all or some of the respective tapes. This also applies to the third to the fifth exemplary embodiments.

In the first exemplary embodiment described above, explanation is given regarding a case in which the positions of the opening hole portions 54A of the drum 25 are identified based on the positions of the slits 62 formed to the circular plate 61 of the circular plate unit 60.

The present invention is however not limited thereto, and the circular plate unit 60 may be omitted. For example, a banknote BL may be regarded as being present when the drum detection light LD cannot be detected over ⅙ of a revolution of the drum 25. Although it takes more time than when employing the circular plate unit 60, it is possible to detect the presence or absence of a banknote BL. This also applies to the second to the fourth exemplary embodiments.

In the first exemplary embodiment described above, explanation is given regarding a case in which the circular plate 61 of the circular plate unit 60 and the drum 25 are attached to the common shaft 25X.

However, the present invention is not limited thereto, and the circular plate 61 may, for example, be attached to a component that rotates in synchronization with the rotation of the drum 25, such as to the shaft of a gear that enmeshes with the shaft 25X. In such cases, it is sufficient for the rotation cycle and phases of the drum 25 and the circular plate 61 to be match each other. This also applies to the second to the fourth exemplary embodiments.

Moreover, in the first exemplary embodiment described above, explanation is given regarding a case in which plural bridge portions 53A of the same size as each other are disposed at uniform intervals around the drum 25 circumferential direction.

However, the present invention is not limited thereto, and, for example, the plural bridge portions 53A may have different sizes to one another. Alternatively, in the present invention the bridge portions 53A may be disposed at non-uniform intervals. In such cases, the shapes of the slits 62 provided to the circular plate 61 may be configured corresponding to the position and size of the opening hole portions 54A, thereby enabling precise identification of whether the cause of the drum detection light LD being blocked is a bridge portion 53A or a banknote BL. This also applies to the second to the fourth exemplary embodiments.

Moreover, in the third exemplary embodiment described above, explanation is given regarding a case in which the bridge portions 53A and 53B are provided with the shaft 25X present inside the groove portions 52A and 52B.

Figure 13:
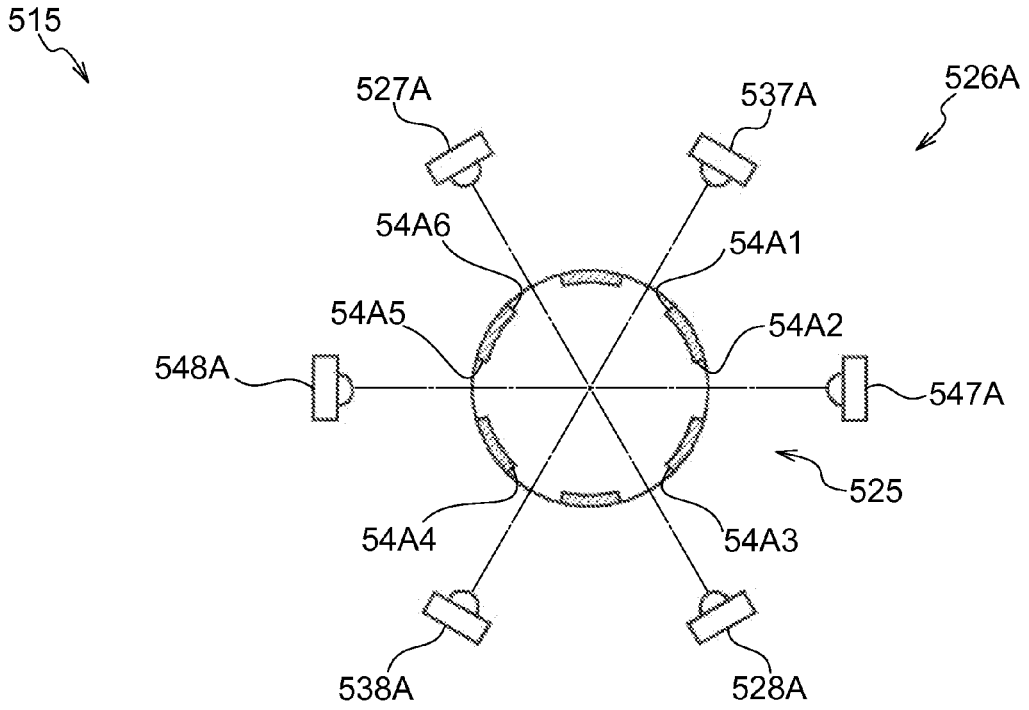
FIG. 13 is a schematic drawing illustrating a configuration of a drum and a detection unit in another exemplary embodiment.
Figure 14A:
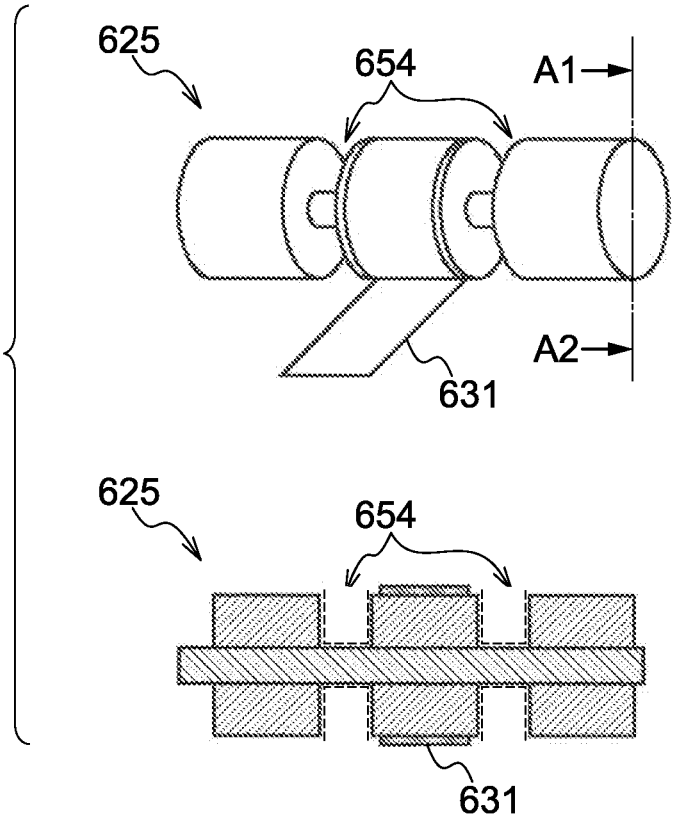
FIG. 14A is a schematic drawing (upper side) and a cross-section (lower side) illustrating a tape slipping off into a groove in a related temporary holding section.
Figure 14B:
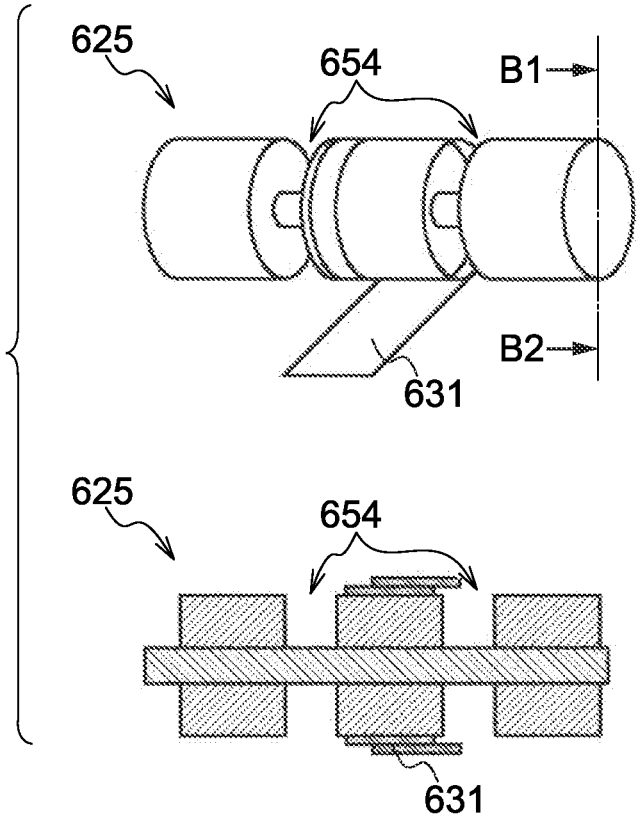
FIG. 14B is a schematic drawing (upper side) and a cross-section (lower side) illustrating a tape slipping off into a groove in a related temporary holding section.
Figure 14C:
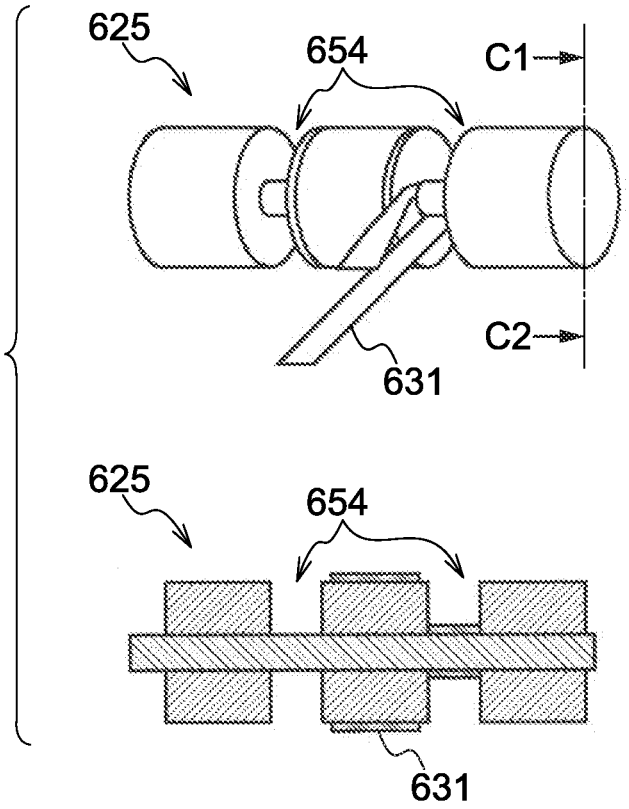
FIG. 14C is a schematic drawing (upper side) and a cross-section (lower side) illustrating a tape slipping off into a groove in a related temporary holding section.

The present invention is however not limited thereto, and, for example, as illustrated in FIG. 13 that corresponds to FIG. 10, the shaft 25X (see FIG. 5) may be omitted in the groove portion 52A of a drum 525, in a configuration in which the circular cylinder portions 51A, 52B are connected together by the bridge portions 53A alone. In particular, in such cases the drum detection light LD may be made to pass through the center of the drum 525. Moreover, three beams of drum detection light LD may respectively travel between three light emitting portions 527A, 537A and 547A and three light receiving portions 528A, 538A and 548A, enabling a reduction in the number of light emitting portions and light receiving portions. This also applies to the fourth exemplary embodiment, in which case a reduction in the number of minors is enabled.

Moreover, in the first exemplary embodiment described above, explanation is given regarding a case in which the radius R, the banknote short edge length S and the bridge number N satisfy Equation (3) with respect to the drum 25 circumferential direction. In the first exemplary embodiment, the drum 25 width direction lengths of each portion satisfy Equation (5) and Equation (6).

However, the present invention is not limited thereto, and other conditions may be satisfied with respect to the circumferential direction and the drum 25 width direction. In such cases, it is sufficient for it to be possible to detect reliably whether or not a single banknote BL has been wound on. The same also applies in the second to the fourth exemplary embodiments.

Moreover, in the first exemplary embodiment described above, explanation is given regarding a case in which the controller 21 determines the presence or absence of a banknote BL based on light reception signals from the light receiving portions 28A and 28B.

The present invention is however not limited thereto, and, for example, the banknote controller 11, the main controller 9, or the banknote controller 11 or the main controller 9 working together with the controller 21, may determine the presence or absence of a banknote BL based on light reception signals from the light receiving portions 28A and 28B.

Moreover, in the first exemplary embodiment described above, explanation is given regarding a case employing the two tapes of the outer tape 31 and the inner tape 33, in which a banknote BL is wound onto the drum 25 circumferential side face in an interposed state between the outer tape 31 and the inner tape 33.

However, the present invention is not limited thereto, and, for example, the inner tape 33 may be omitted, with a banknote BL pressed against the circumferential side face of the drum 25 by the outer tape 31 alone. This also applies in the second to the fifth exemplary embodiments.

Moreover, in the first exemplary embodiment described above, explanation is given regarding a case in which a medium of a banknote BL is held in the temporary holding section 15 of the automated teller machine 1 that performs cash transactions with a customer, such as in a financial institution.

However, the present invention is not limited thereto, and, for example, the present invention may be applied to a temporary holding section incorporated in an accounting system used by a cashier to perform various cash-related processing, such as in a financial institution. The present invention may also be applied to various devices that hold a paper shaped medium, such as shopping vouchers, cash vouchers, or entrance tickets. This also applies to the second exemplary embodiment to the fifth exemplary embodiment.

Moreover, in the first exemplary embodiment described above, explanation is given regarding a case in which the temporary holding section 15 serving as an example of a medium processing apparatus is configured by: the drum 25 serving as an example of a drum; the outer tape 31 and the inner tape 33 serving as examples of tapes; the groove portions 52A and 52B serving as examples of groove portions; the bridge portions 53A and 53B serving as examples of bridge portions; the detection units 26A and 26B serving as examples of detection units; and the controller 21 serving as an example of a controller.

However, the present invention is not limited thereto, and the medium processing apparatus may be configured using various other types of drum, tape, groove portion, bridge portion, detection unit and controller.

INDUSTRIAL APPLICABILITY

The present invention may be employed in various devices that temporarily hold a paper shaped medium, such as a banknote, wound onto a drum together with a tape.

The disclosure of Japanese Patent Application No. 2012-073996 is incorporated by reference in its entirety in the present specification. All cited documents, patent applications and technical standards mentioned in the present specification are incorporated by reference in the present specification to the same extent as if the individual cited document, patent application, or technical standard was specifically and individually indicated to be incorporated by reference.

The invention claimed is:

1. A medium processing apparatus, comprising:

a drum that is formed in a substantially circular cylinder shape, and that rotates about a central shaft at the center of the drum;

a tape that is wound onto a circumferential side face of the drum together with a paper sheet-shaped medium;

a groove portion that is formed around a circumferential direction of the drum;

a plurality of bridge portions that span between the two sides of the groove portion at discrete locations around the circumferential direction of the drum;

a detection unit that emits detection light toward the groove portion and that receives the detection light that has passed through an opening hole portion that is a gap between the bridge portions in the groove portion; and a controller that determines whether or not the medium is wound onto the circumferential side face of the drum based on a light reception result for the detection light by the detection unit.

2. The medium processing apparatus of claim 1, wherein:

the medium processing apparatus further comprises a bridge position detection unit that detects bridge positions at which the bridge portions are formed to the drum; and the controller determines whether or not the medium is wound onto the drum circumferential side face based on the light reception result for the detection light and a detection result for the bridge positions.

3. The medium processing apparatus of claim 2, wherein:

the bridge position detection unit comprises:

a circular plate that rotates in synchronization with rotation of the drum, pass-through portions that are formed at locations on the circular plate corresponding to locations of the drum at which the bridge portions are not formed, and that allow a predetermined circular plate detection light to pass through, a circular plate light emitting portion that emits the circular plate detection light toward the circular plate, and a circular plate light receiving portion that receives the circular plate detection light through the circular plate; and the controller identifies positions at which the bridge portions are formed to the drum based on a light reception result for the circular plate detection light.

4. The medium processing apparatus of claim 1, wherein:

the detection unit comprises a plurality of light emitting portions that emit the detection light and a plurality of light receiving portions that receive the detection light, and passes a plurality of beams of the detection light through all of the opening hole portions in parallel.

5. The medium processing apparatus of claim 1, wherein:

the detection unit comprises one light emitting portion that emits the detection light, one light receiving portion that receives the detection light, and a plurality of mirrors that reflect the detection light, and uses the light receiving portion to receive the detection light emitted from the light emitting portion after the detection light has passed through all of the opening hole portions while being reflected in sequence by the mirrors.

6. The medium processing apparatus of claim 1, wherein:

equation $N \geq 4\pi R/S$ is satisfied, wherein S is length of the circumferential direction of the medium, R is the radius of the drum, N is the number of the bridge portions around the circumferential direction of the drum.

7. The medium processing apparatus of claim 1, wherein:

the groove portion comprises a plurality of groove portions formed respectively at the two sides of a winding location where the tape is wound, and wherein the drum comprises guide plates at both width direction end portions along the central shaft of the drum, and which guide the medium; and the bridge portions satisfy $W1 < B - C$, wherein B is the length of the medium in a direction along the central shaft, C is the length of the tape in the direction along the central shaft, and W1 is the separation from the guide plate to a nearest detection light illumination location.

8. The medium processing apparatus of claim 7, wherein:

the bridge portions satisfy $C < W2 < B$, wherein W2 is a separation between the illumination locations of the detection light at the groove portions respectively formed at the two sides of the tape winding location.

* * * * *